US011513461B2

(12) United States Patent
Yamamura

(10) Patent No.: US 11,513,461 B2
(45) Date of Patent: Nov. 29, 2022

(54) IMAGE FORMING APPARATUS AND IMAGE QUALITY ADJUSTMENT METHOD

(71) Applicant: Ricoh Company, Ltd., Tokyo (JP)

(72) Inventor: Hiroki Yamamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/307,076

(22) Filed: May 4, 2021

(65) Prior Publication Data

US 2021/0356892 A1 Nov. 18, 2021

(30) Foreign Application Priority Data

May 13, 2020 (JP) ..... JP2020-084609

(51) Int. Cl.
*G03G 15/00* (2006.01)

(52) U.S. Cl.
CPC ..... *G03G 15/5058* (2013.01); *G03G 15/5016* (2013.01); *G03G 15/5062* (2013.01)

(58) Field of Classification Search
CPC ..... G03G 15/5058; G03G 15/5062
See application file for complete search history.

(56) References Cited

U.S. PATENT DOCUMENTS 7,509,065 B2 * 3/2009 Itagaki ..... G03G 15/5033 399/72
8,610,971 B2 * 12/2013 Omori ..... H04N 1/506 358/475
8,638,481 B2 * 1/2014 Miyadera ..... G03G 15/0131 358/1.9
10,353,315 B2 * 7/2019 Imai ..... G03G 15/502
10,599,961 B2 * 3/2020 Toriyabe ..... H04N 1/6055
2019/0163108 A1 5/2019 Sakurada et al.
2020/0074598 A1 3/2020 Yamamura et al.
2020/0294207 A1 9/2020 Yamamura et al.
2020/0301326 A1 9/2020 Yamazaki et al.

FOREIGN PATENT DOCUMENTS

JP 2007-072246 3/2007
JP 2010-109701 5/2010
JP 2011-161813 8/2011

* cited by examiner

*Primary Examiner* — Leon W Rhodes, Jr.
(74) *Attorney, Agent, or Firm* — Xsensus LLP

(57) ABSTRACT

An image forming apparatus includes an image forming device and circuitry. The image forming device forms an image on a recording material. The circuitry executes image quality adjustment control for adjusting image quality of the image formed by the image forming device. The circuitry is configured to selectively execute a first control mode for executing first image quality adjustment control and a second control mode including both the first image quality adjustment control and second image quality adjustment control. The circuitry executes only the second image quality adjustment control without executing the first image quality adjustment control in a case in which an execution skip condition for skipping the first image quality adjustment control is satisfied even when an execution condition for executing the second control mode is satisfied.

16 Claims, 18 Drawing Sheets

IMAGE FORMING APPARATUS AND IMAGE QUALITY ADJUSTMENT METHOD

CROSS-REFERENCE TO RELATED APPLICATION

This patent application is based on and claims priority pursuant to 35 U.S.C. § 119(a) to Japanese Patent Application No. 2020-084609, filed on May 13, 2020, in the Japan Patent Office, the entire disclosure of which is hereby incorporated by reference herein.

BACKGROUND

Technical Field

Embodiments of the present disclosure relate to an image forming apparatus and an image quality adjustment method.

Related Art

There is known an image forming apparatus that includes an image forming unit to form an image on a recording material and an image quality adjustment unit to execute image quality adjustment control for adjusting image quality of the image formed by the image forming unit.

For example, an image forming apparatus is known that executes density correction control (image quality adjustment control) before execution of the next new print job, when a measurement execution condition is satisfied that an elapsed time from execution of the previous density measurement, the number of printed sheets, or a temperature change is equal to or larger than a reference value. In such an image forming apparatus, when the measurement execution condition is not satisfied, the density correction control (image quality adjustment control) is not executed before execution of the next new print job.

SUMMARY

According to an aspect of the present disclosure, there is provided an image forming apparatus that includes an image forming device and circuitry. The image forming device forms an image on a recording material. The circuitry executes image quality adjustment control for adjusting image quality of the image formed by the image forming device. The circuitry is configured to selectively execute a first control mode for executing first image quality adjustment control and a second control mode including both the first image quality adjustment control and second image quality adjustment control. The circuitry executes only the second image quality adjustment control without executing the first image quality adjustment control in a case in which an execution skip condition for skipping the first image quality adjustment control is satisfied even when an execution condition for executing the second control mode is satisfied.

According to another aspect of the present disclosure, there is provided an image quality adjustment method for an image forming apparatus that forms an image on a recording material and executes image quality adjustment control for adjusting image quality of the image formed. The image quality adjustment method includes selectively executing a first control mode for executing first image quality adjustment control and a second control mode including both the first image quality adjustment control and second image quality adjustment control; and executing only the second image quality adjustment control without executing the first image quality adjustment control in a case in which an execution skip condition for skipping the first image quality adjustment control is satisfied even when an execution condition for executing the second control mode is satisfied.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
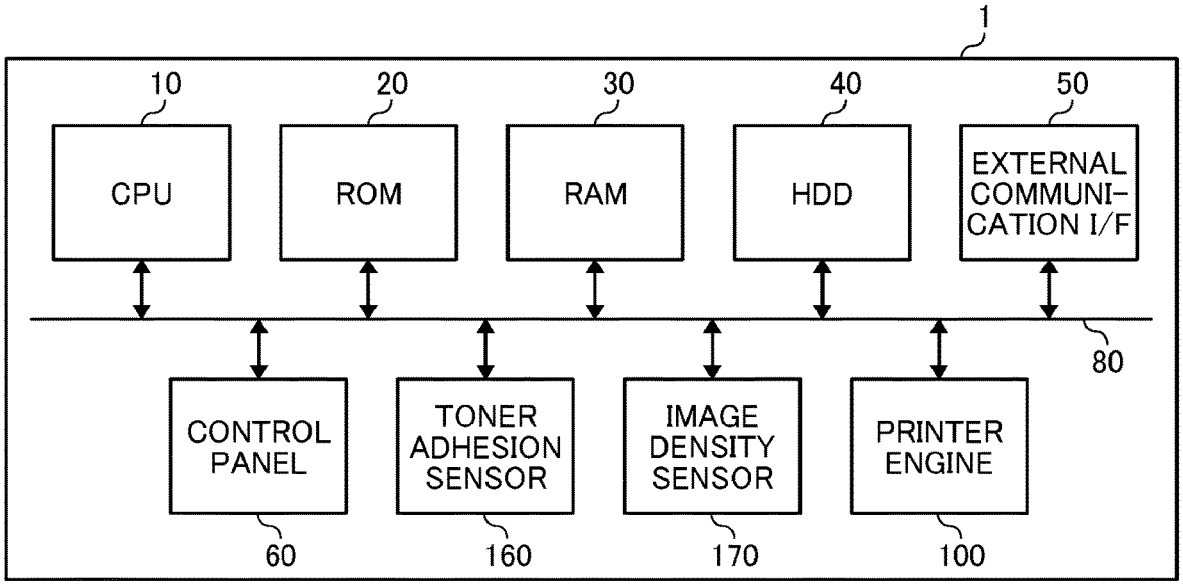
FIG. 1 is a block diagram illustrating a hardware configuration related to control of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Below, a description is given of an image forming apparatus according to an embodiment of the present disclosure. FIG. 1 is a block diagram illustrating a hardware configuration related to control of an image forming apparatus according to an embodiment of the present disclosure. As illustrated in FIG. 1, the image forming apparatus 1 according to the present embodiment includes a central processing unit (CPU) 10, a read only memory (ROM) 20, a random access memory (RAM) 30, a hard disk drive (HDD) 40, an external communication interface (I/F) 50, an operation panel 60, a printer engine 100, a toner adhesion amount sensor 160, and an image density sensor 170. A system bus 80 interconnects the above-described elements.

The CPU 10 controls operations of the image forming apparatus 1. Specifically, the CPU 10 executes programs stored in the ROM 20 or the HDD 40, using the RAM 30 as a work area to control the operations of the entire image forming apparatus 1 and implement various functions, such as copying, scanning, faxing, and printing. The CPU 10 also functions as an image quality adjustment unit that performs image quality adjustment control of an image to be formed by executing a program stored in the ROM 20 or the HDD 40.

The ROM 20 is a nonvolatile semiconductor memory that can retain data even when a power source is turned off. The RAM 30 is a volatile semiconductor memory that temporarily stores a program or data. The HDD 40 is a nonvolatile memory that stores programs or data. Programs and data stored in the HDD 40 include an operating system (OS), which is basic software for controlling the entire image forming apparatus 1, various application programs operating on the OS, and operation conditions of various functions such as the copy function, the scanner function, the facsimile function, and the printer function mentioned above. The HDD 40 can further store operations of such various functions (hereinafter also "jobs"), including operations of the image forming apparatus 1 and so on, each time each job is executed.

The external communication I/F 50 is an interface to connect the image forming apparatus 1 to a network, such as the Internet or a local area network (LAN). The image forming apparatus 1 can receive a print instruction, image data, and the like from external devices via the external communication I/F 50.

The operation panel 60 serves as an input receiving device to receive various types of input according to the user's operation and displays various types of information (for example, information indicating the received operation, information indicating the operation status of the image forming apparatus 1, or information indicating the setting status of the image forming apparatus 1). In one example, the operation panel 60 is, but not limited to, a liquid crystal display (LCD) having a touch panel function. For another example, the operation panel 60 may include an organic electroluminescence (EL) display functioning as the touch panel. In addition to or instead of the above-described operation panel, an operation device such as a hardware key or a display device such as a lamp may be provided. The operation panel 60 is controlled by the CPU 10.

A printer engine 100 as an image forming device is hardware for realizing a printer function, a copy function, a facsimile function, and the like, and functions as an image forming device that forms an image on a sheet as a recording material. As the printer function, an electrophotographic method, an inkjet method, or the like can be applied, but the printer function is not limited thereto. The printer engine 100 may further include an optional device, such as a finisher that sorts printed sheets or such as an automatic document feeder (ADF) that automatically feeds an original document. The printer engine 100 is controlled by the CPU 10.

The image forming apparatus 1 may also include an external interface to read and write an external storage medium, such as a compact disc (CD), a digital versatile disc (DVD), a secure digital (SD) memory card, or a universal serial bus (USB) memory, via the external interface.

The programs stored in the ROM 20 or the HDD 40 can be processed by a computer. The programs may be installed in the ROM 20 or the HDD 40 at the time of manufacture or shipment of the image forming apparatus 1 or may be installed after sale. As a method of installing programs after sale, for example, the programs can be installed via an external storage medium drive using an external storage medium storing the programs or via a network using the external communication I/F 50.

Figure 2:
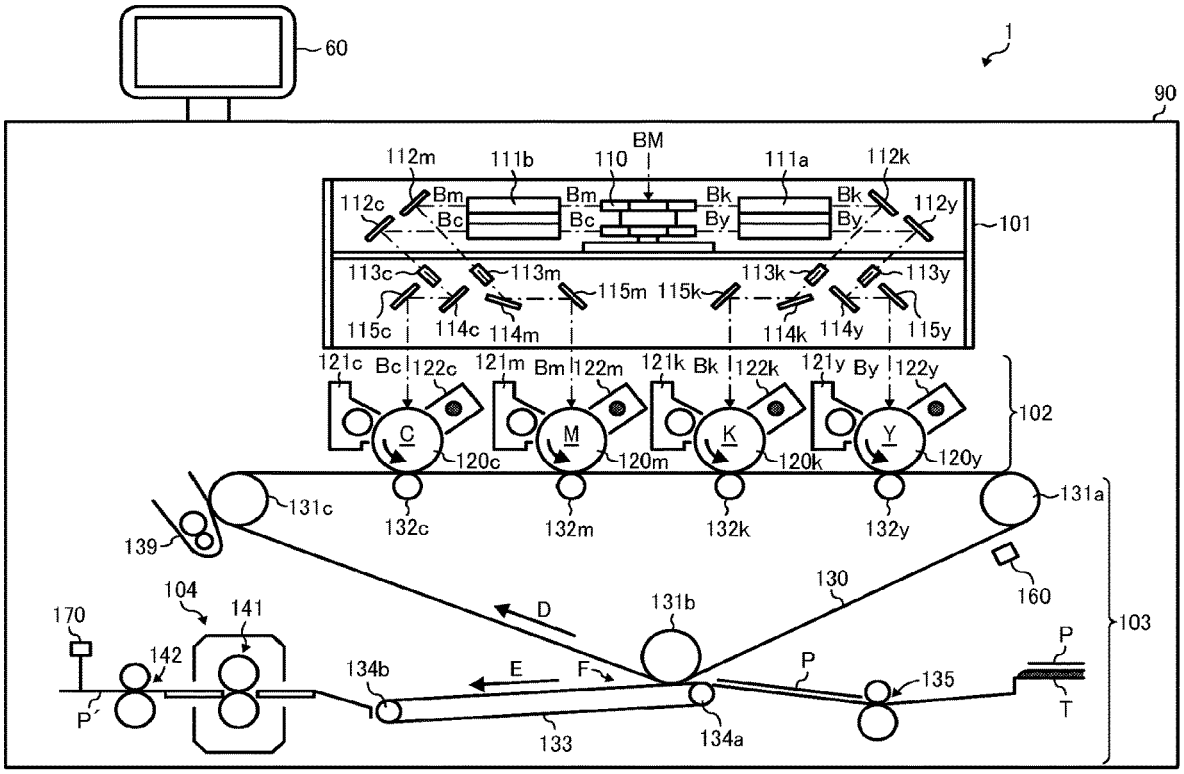
FIG. 2 is a schematic diagram illustrating a hardware configuration of a printer engine in the image forming apparatus of FIG. 1.

FIG. 2 is a schematic view illustrating a hardware configuration of the printer engine 100. The printer engine 100 is disposed inside a housing 90 of the image forming apparatus 1 and includes an exposure device 101, an image forming unit 102, a transfer device 103, and a fixing device 104. The operation panel 60 is disposed on the housing 90.

The image forming unit 102 includes a photoconductor 120*y* for yellow (Y), a photoconductor 120*k* for black (K), a photoconductor 120*m* for magenta (M), and photoconductor 120*c* for a cyan (C), each of which is an image bearer. The image forming unit 102 further includes a developing device 121*y*, a developing device 121*k*, a developing device 121*m*, and a developing device 121*c* for yellow, black, magenta, and cyan, respectively. The image forming unit 102 further includes a charger 122*y* for yellow (Y), a charger 122*k* for black (K), a charger 122*m* for magenta (M), and a charger 122*c* for cyan (C) as charging devices.

The transfer device 103 includes an intermediate transfer belt 130 as an intermediate transferor, which is an image bearer, and a secondary transfer belt 133. The fixing device 104 includes a fixing member 141, an ejection roller 142, and the like.

Hereinafter, a function of forming an image on a sheet as a recording material based on image data is described as an example of functions of the printer engine 100 as an image forming device with reference to FIG. 2.

The exposure device 101 emits writing light for writing latent images corresponding to image data on the photoconductors 120*y*, 120*k*, 120*m*, and 120*c* of the image forming unit 102 and exposes the photoconductors 120*y*, 120*k*, 120*m*, and 120*c* (hereinafter, also collectively referred to as "photoconductors 120*y* to 120*c*"). That is, the light beam is selectively emitted at a writing position corresponding to an image pattern of the image data and at a writing light amount corresponding to the image density. Light from a laser light source or a light emitting diode (LED) light source can be used as the writing light. The following description is provided of an example using a laser light source including a laser diode (LD).

First, a light beam BM emitted from a laser light source is deflected by a polygon mirror 110 and enters scanning lenses 111*a* and 111*b* each including an fθ lens. The light beams are generated corresponding to images of respective colors of yellow (Y), black (K), magenta (M), and cyan (C) in number and reflected by reflection mirrors 112*y*, 112*k*, 112*m*, and 112*c* (hereinafter, also collectively referred to as "reflection mirrors 112*y* to 112*c*") after passing through the scanning lenses 111*a* and 111*b*. For example, a yellow light beam By permeates through the scanning lens 111*a*, is reflected by the reflection mirror 112*y*, and enters a wide toroidal lens (WTL) lens 113*y*. A black light beam Bk, a magenta light beam Bm, and a cyan light beam Bc are guided in a similar manner, and redundant descriptions are omitted.

WTL lenses 113*y*, 113*k*, 113*m*, and 113*c* shape the incident light beams By, Bk, Bm, and Bc (hereinafter, also collectively referred to as "the light beams By to Bc"), respectively, and then deflect the light beams By to Bc to the reflection mirrors 114*y*, 114*k*, 114*m*, and 114*c* (hereinafter, also collectively referred to as "reflection mirrors 114*y* to 114*c*"). Then, the light beams By, Bk, Bm, and Bc are further reflected by the reflection mirrors 115*y*, 115*k*, 115*m*, and 115*c* (hereinafter, also collectively referred to as "reflection mirrors 115*y* to 115*c*"), and are irradiated onto the photoconductors 120*y* to 120*c* as the light beams By to Bc used for exposure.

The irradiation of the light beams By to Bc onto the photoconductors 120*y* to 120*c* is synchronized in timing with respect to the main-scanning direction and the sub-scanning direction on the photoconductors 120*y* to 120*c*. In addition, the photoconductor is, for example, shaped like a drum that is long in the main scanning direction and may be referred to as a photoconductor drum.

Hereinafter, the main-scanning direction on the photoconductors 120*y* to 120*c* is defined as the scanning direction of the light beams By to Bc, and the sub-scanning direction is defined as the direction orthogonal to the main-scanning direction, that is, the direction of rotation of the photoconductors 120*y* to 120*c*.

The photoconductors 120*y* to 120*c* include a photoconductive layer including at least a charge generation layer and a charge transport layer on a conductive drum such as aluminum. The respective photoconductive layers of the photoconductors 120*y* to 120*c* and are charged by the chargers 122*y* to 122*c*, each of which includes a scorotron charger, a scorotron charger, a charging roller, or the like. Thus, the photoconductors 120*y* to 120*c* gain surface charges according to charging biases.

The photoconductors 120*y* to 120 given electrostatic charges by the chargers 122*y* to 122*c* are exposed by the light beams By to Bc as the writing light in accordance with the image pattern, and electrostatic latent images are formed on the surfaces scanned by the chargers 122*y* to 122*c*.

The electrostatic latent images respectively formed on the surfaces of the photoconductors 120*y* to 120*c* are developed by developing devices 121*y* to 121*c* to from toner images on scanned surface of the photoconductors 120*y* to 120*c*. Each of the developing devices 121*y* to 121*c* includes a developing roller to which a developing bias is applied, a toner supply roller, and a regulation blade.

The respective toner images carried on the photoconductors 120*y* to 120*c* are transferred onto the intermediate transfer belt 130 rotating in the direction indicated by arrow D by conveyance rollers 131*a*, 131*b*, and 131*c*. The toner images are superimposed one on another, forming a multicolor image. Primary transfer rollers 132*y*, 132*k*, 132*m*, and 132*c* (transfer devices) are disposed opposite the photoconductors 120*y*, 120*k*, 120*m*, and 120*c*, respectively. The intermediate transfer belt 130, onto which the yellow, black, magenta, and cyan toner images are transferred from scanned surfaces of the photoconductors 120*y* to 120*c*, is conveyed to a secondary transfer position F. The toner images are transferred from the scanned surfaces of the photoconductors 120*y* to 120*c* onto the intermediate transfer belt 130.

The secondary transfer belt 133 is wound around conveyance rollers 134*a* and 134*b* and conveyed in the direction indicated by arrow E by the conveyance rollers 134*a* and 134*b*. At the secondary transfer position F, a sheet P is fed from a sheet container T such as a sheet feeding tray by a conveyance roller 135. The sheet P is a recording medium, such as fine paper or a plastic sheet. At the secondary transfer position F, with application of a secondary transfer bias, a toner image borne on the intermediate transfer belt 130 is transferred onto the sheet P attracted and carried onto the secondary transfer belt 133. The sheet P is conveyed in the direction orthogonal to the main scanning direction.

As the secondary transfer belt 133 is conveyed, the sheet P is fed to the fixing device 104. The fixing device 104 includes the fixing member 141 such as a fixing roller including silicon rubber or fluoro-rubber. The toner image is fixed onto the sheet P under heat and pressure applied by the fixing device 104. Then, a sheet P' bearing the multicolor toner image is ejected outside the fixing device 104 by the output roller pair 142.

After the toner image is transferred from the intermediate transfer belt 130, a cleaning device 139 including a cleaning blade removes residual toner from the intermediate transfer belt 130. Then, the intermediate transfer belt 130 is used in a next image forming process.

In the above-described operation of the printer engine 100, the direction of rotation of the photoconductors 120*y* to 120*c*, the direction of conveyance of the intermediate transfer belt 130, and the direction of conveyance of the sheet P and the sheet P' (hereinafter referred to as "sheet conveyance direction") are all orthogonal to the main-scanning direction and the same as the sub-scanning direction.

As described above, the printer engine 100 serving as an image forming device forms an image on a sheet based on image data.

Figure 3:
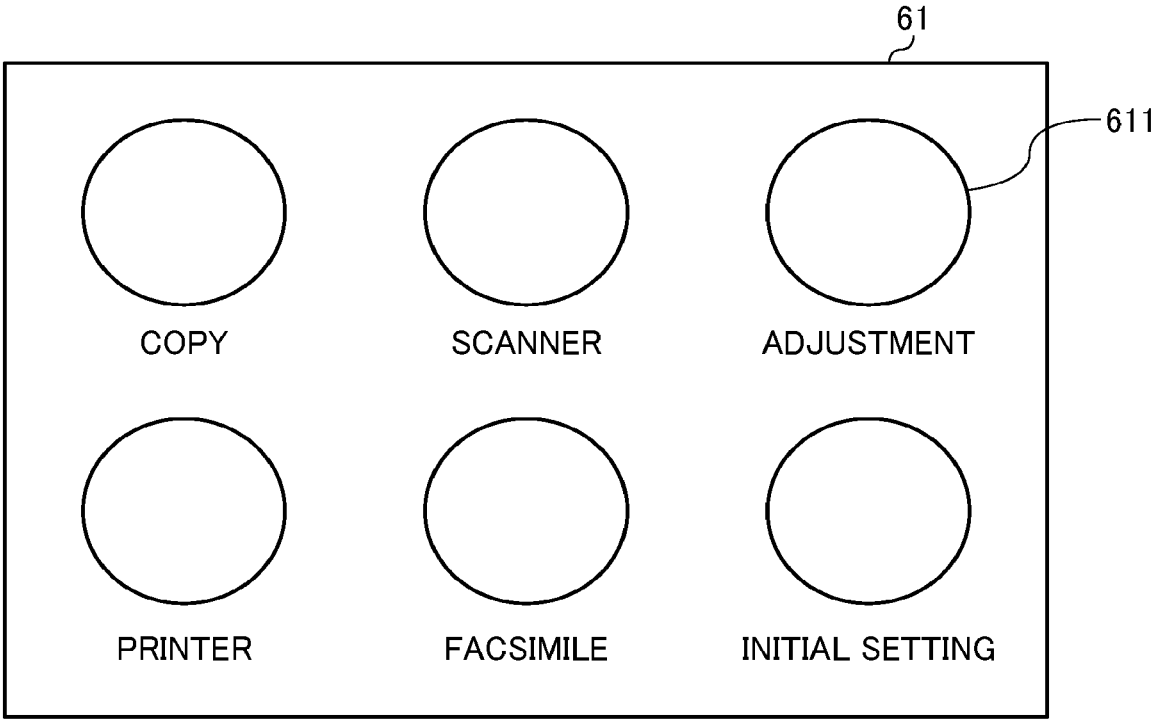
FIG. 3 is an illustration of an example of an operation screen displayed on an operation panel of the image forming apparatus of FIG. 1.

Next, a description is given of image quality adjustment control for adjusting the image quality of an image formed by the printer engine 100. FIG. 3 is an illustration of an operation screen 61 displayed on the operation panel 60 of the image forming apparatus 1 according to the present embodiment. On the operation screen 61 displayed on the operation panel 60, icons for activating respective functions are displayed. The user can use an adjustment function by touching an "adjustment" icon 611.

Figure 4A:
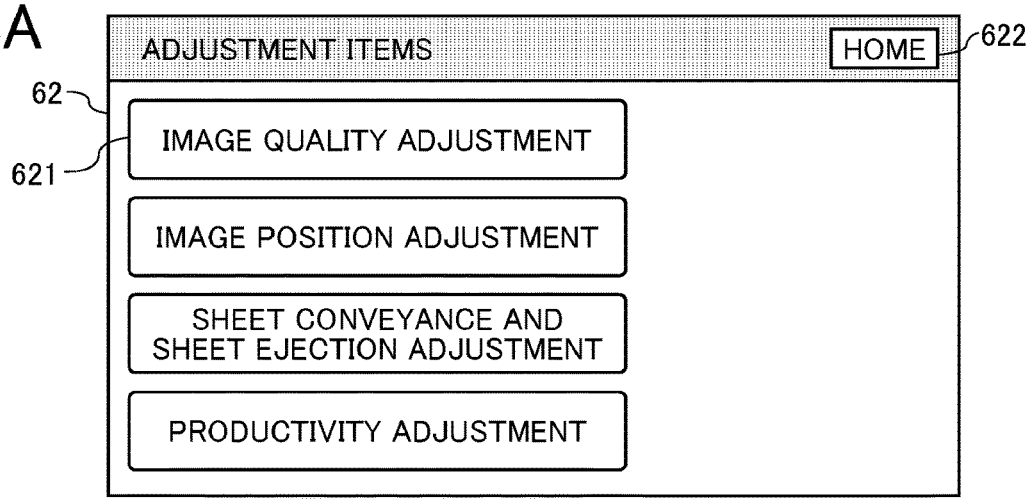
FIG. 4A is an illustration of an example of an adjustment item screen displayed on the operation panel.
Figure 4B:
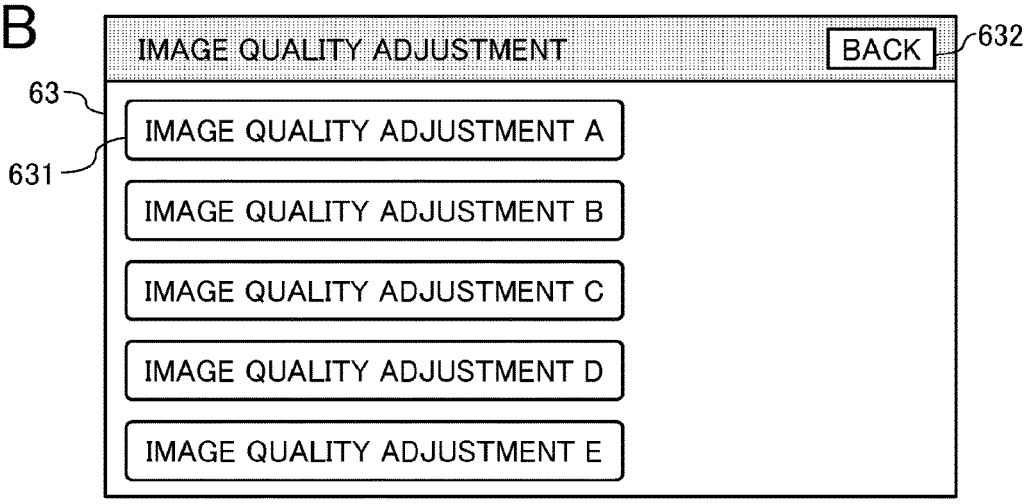
FIG. 4B is an illustration of an example of an image quality adjustment screen displayed on the operation panel.
Figure 4C:
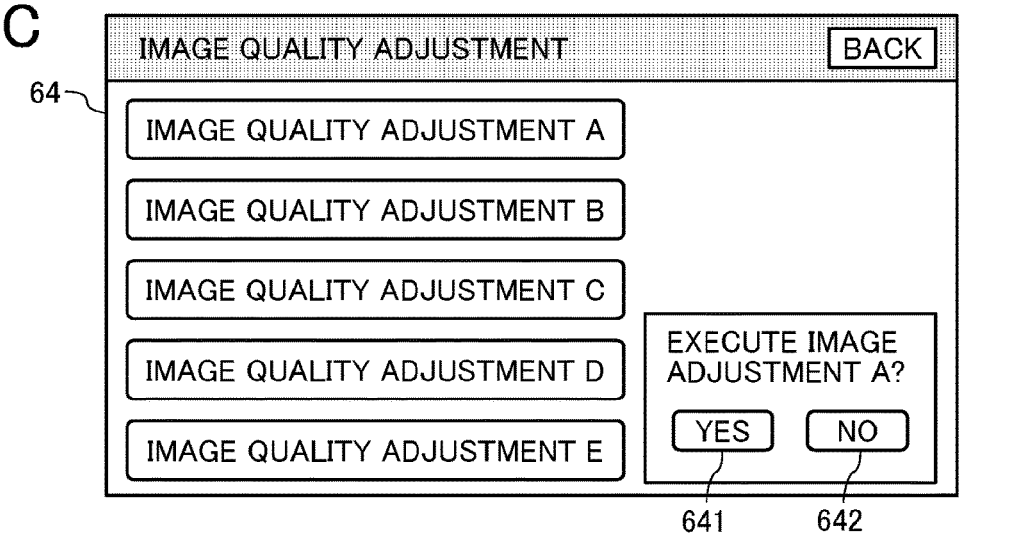
FIG. 4C is an illustration of an example of an adjustment execution confirmation screen displayed on the operation panel.

FIGS. 4A, 4B, and 4C are illustrations of examples of adjustment item screens 62, 63, and 64 displayed on the operation panel 60. When the "adjustment" icon 611 is touched on the operation screen 61 illustrated in FIG. 3, the display on the operation panel 60 transitions to an adjustment item screen 62 illustrated in FIG. 4A. The items displayed on the adjustment item screen 62 are not limited to the items illustrated in FIG. 4A. When the "image quality adjustment" icon 621 is touched on the adjustment item screen 62, the display on the operation panel 60 transitions to an image quality adjustment screen 63 illustrated in FIG. 4B. The image quality adjustment screen 63 displays image quality adjustment items that can be executed by the user.

When, for example, the "image quality adjustment A" icon 631 is touched on the image quality adjustment screen 63, the display on the operation panel 60 transitions to an adjustment execution confirmation screen 64 illustrated in FIG. 4C. In the adjustment execution confirmation screen 64, when a "Yes" icon 641 that permits execution is touched, image quality adjustment control corresponding to the image quality adjustment A that is a control mode is executed. When a "No" icon 642 that does not permit execution is touched, the screen returns to the image quality adjustment screen 63 illustrated in FIG. 4B.

When the "return" icon 632 is touched on the image quality adjustment screen 63, the display on the operation panel 60 transitions to the adjustment item screen 62 illustrated in FIG. 4A. When the "home" icon 622 is touched on the adjustment item screen 62, the display on the operation panel 60 transitions to the operation screen 61 illustrated in FIG. 3.

Examples of the type of image quality adjustment (control mode) displayed on the image quality adjustment screen 63 include "image density adjustment" for adjusting the density of an output image, "main scanning image density deviation adjustment" or "sub scanning image density deviation adjustment" for correcting image density deviation in the main scanning direction or the sub scanning direction, and "gradation correction" for correcting the gradation of image density.

The type of image quality adjustment (control mode) displayed on the image quality adjustment screen 63 may be a part of control modes executable by the image forming apparatus 1. As described later, the image quality adjustment control may be performed using a result of detection of the toner adhesion amount of a toner image on the intermediate transfer belt 130 by the toner adhesion amount sensor 160, or may be performed using a result of detection of the density of an image on a sheet P before or after passing through the fixing device 104 by the image density sensor 170.

Next, a control mode for image quality adjustment in the present embodiment is described. When the situation has not changed significantly after the execution of the control mode including the image quality adjustment control, such as immediately after the execution of the control mode, there is little need to execute the same control mode again. Therefore, conventionally, when the elapsed time from the previous execution, the number of printed sheets, or the temperature change is less than a reference, the same control mode may not be executed. Such a configuration can restrain a failure such as time loss of control time due to execution of unnecessary image quality adjustment control, wasteful consumption of consumables (toner or the like) due to the execution, and deterioration of components due to the execution.

However, it is conceivable to selectively perform a control mode (first control mode) in which a certain type of image quality adjustment control A (first image quality adjustment control) is performed and a different type of control mode (second control mode) including both the image quality adjustment control A and a different type of image quality adjustment control B (second image quality adjustment control). For example, if it is desirable that the image quality adjustment control A has been executed in advance in execution of the image quality adjustment control B, the control mode (second control mode) in which both the image quality adjustment control A and the image quality adjustment control B are executed may be provided. In such a case, the execution condition for executing the second control mode may be satisfied at a point in time when the situation has not changed significantly after the execution of the image quality adjustment control A. In this case, when the second control mode is executed, the image quality adjustment control A, which is not required to be executed, is also executed, which may cause a failure such as time loss, wasteful consumption of consumables, or component deterioration.

Specifically, if the "image quality adjustment B" (second control mode) that performs the image quality adjustment control A and the image quality adjustment control B is not displayed on the image quality adjustment screen 63 described above and is a control mode that cannot be executed by a user instruction, the execution timing and the execution frequency can be managed by a program. However, as in the present embodiment, when "image quality adjustment B" is displayed on the image quality adjustment screen 63 illustrated in FIG. 4B and can be executed by an instruction of the user, the execution timing and the execution frequency may not be managed by the program. In this case, for example, the "image quality adjustment A" (first control mode) for performing the image quality adjustment control A is programmed to be executed at the end of a print job. When the user executes the "image quality adjustment B" (image quality adjustment control A+B) from the image quality adjustment screen 63 immediately after the end of the print job, the image quality adjustment control A executed immediately before is executed although it is not necessary to be executed, which may cause a failure such as time loss, wasteful consumption of consumables, or component deterioration.

Therefore, in the present embodiment, in a case in which an execution skip condition for skipping the image quality adjustment control A is satisfied even when an execution condition for executing "image quality adjustment B" (image quality adjustment control A and image quality adjustment control B) is satisfied, only the image quality adjustment control B is executed without executing the image quality adjustment control A. When the execution condition for executing the "image quality adjustment B" is satisfied, such a configuration can avoid execution of the image quality adjustment control A which is not necessary to be executed. Accordingly, when the "image quality adjustment B" is executed, it is possible to restrain failures such as the time loss, the wasteful consumption of consumables, and the deterioration of components due to the execution of the first image quality adjustment control which is not necessary to be executed.

Control Example 1

Figure 5:
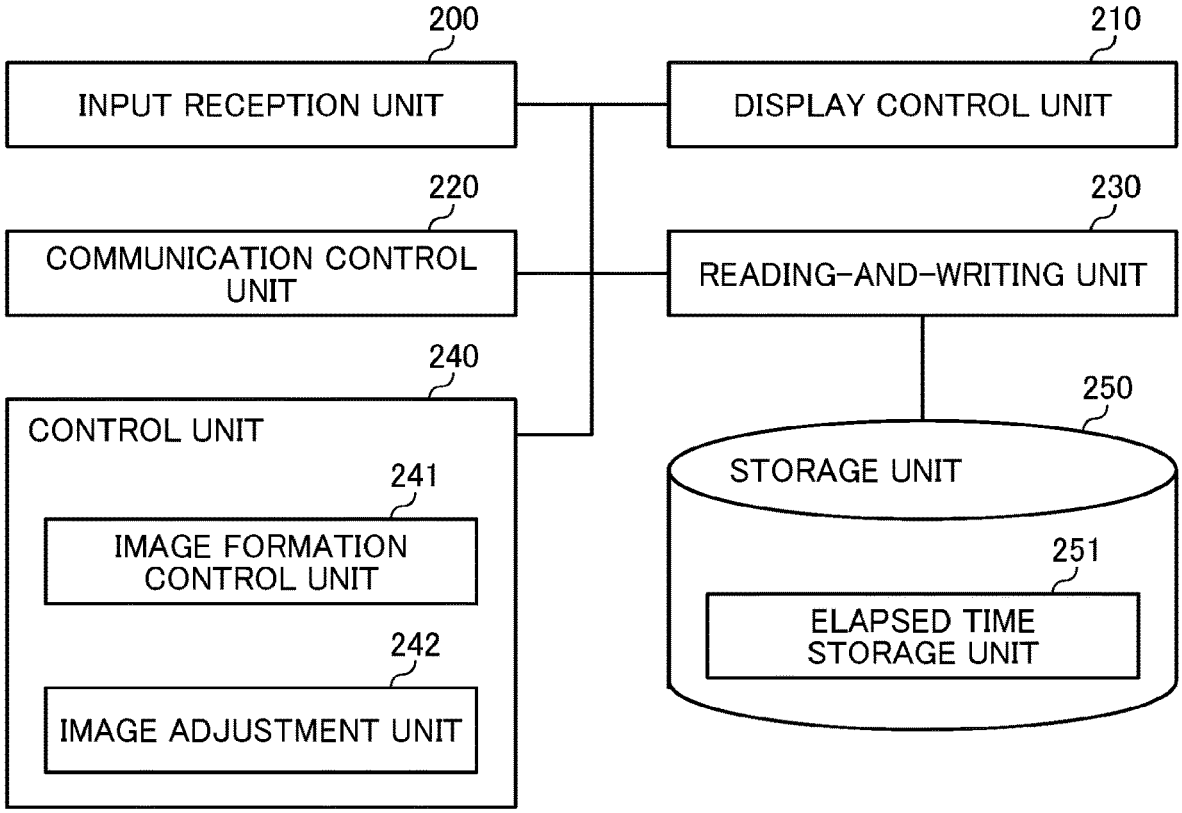
FIG. 5 is a functional block diagram relating to image quality adjustment control in a control example 1.

Hereinafter, a description is given of one control example (hereinafter, this control example is referred to as "control example 1") of the image quality adjustment control according to the present embodiment. FIG. 5 is a functional block diagram relating to image quality adjustment control of the present control example 1. An input receiving unit 200 is implemented by the operation panel 60. The input receiving unit 200 performs functions of displaying information necessary for operation to a user and receiving various inputs made by the user. The input receiving unit 200 is also implemented by the processing of the external communication I/F 50 and performs s function of receiving a print instruction or setting change input by the user from an external device via a local area network (LAN) or the Internet.

A display control unit 210 is implemented by the CPU 10 executing a program stored in the ROM 20 or the HDD 40, using the RAM 30 as a work area. The display control unit 210 performs a function of controlling a display screen to be displayed on the input receiving unit 200.

A communication control unit 220 is implemented by the processing of the external communication I/F 50. The communication control unit 220 performs functions of transmitting image data to the outside via email or communicating with an external device via a network when various types of setting data can be set from the external device.

A reading-and-writing unit 230 is implemented by the CPU 10 executing a program stored in the RAM 30 or the HDD 40 using ROM 20 as a work area. The reading-and-writing unit 230 performs functions of storing various data in a storage unit 250 and reading such various data stored in the storage unit 250.

A control unit 240 is implemented by the CPU 10 executing a program stored in the ROM 20 or the HDD 40, using the RAM 30 as a work area. The control unit 240 performs functions of the entire image forming apparatus, for example, a copy function, a scanner function, a printer function, and a facsimile function.

The control unit 240 includes an image formation control unit 241 and an image quality adjustment unit 242. The image formation control unit 241 executes a function of controlling the printer engine 100 as an image forming device. As an example, the image formation control unit 241 can execute image formation under image formation conditions corresponding to the type of sheet included in a print instruction by the user. The image quality adjustment unit 242 adjusts the image quality of an image formed by the image formation control unit 241 in accordance with a command by a program (for example, automatic execution at a predetermined timing) or a command by a user's instruction input to the operation panel 60.

The storage unit 250 is configured by the ROM 20 or the HDD 40, and performs a function of storing programs, document data, image forming conditions and various setting information necessary for operations of the image forming apparatus 1, operation logs of the image forming apparatus 1, and the like. Examples of the image forming conditions include a charging bias, a developing bias, an optical writing light amount, and a transfer bias. The various types of information stored in the storage unit 250 may be set before shipment of the image forming apparatus 1 or may be updated after shipment.

The storage unit 250 includes an elapsed time storage unit 251. The elapsed time storage unit 251 stores the elapsed time from the last execution for each type of image quality adjustment control.

Figure 6:
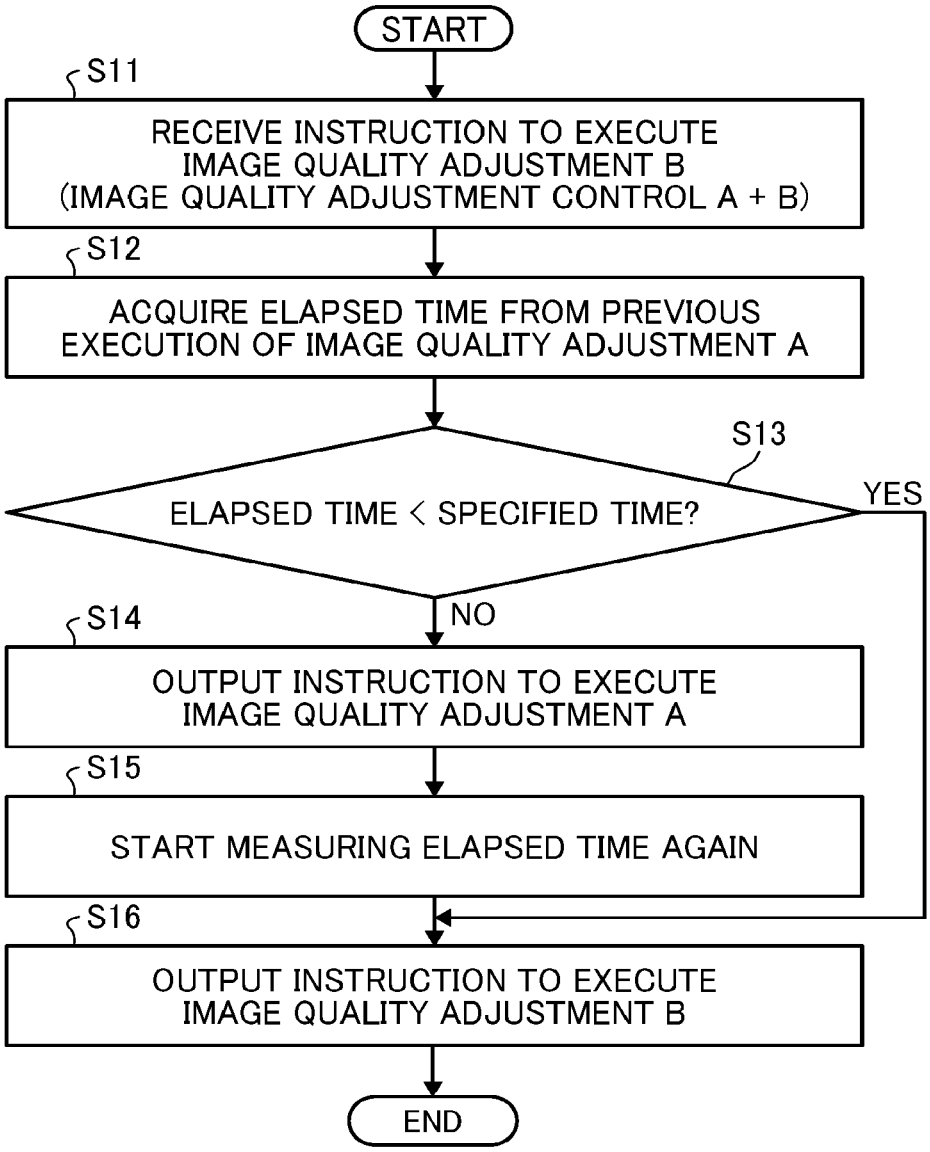
FIG. 6 is a flowchart illustrating an execution flow of the image quality adjustment control in the control example 1.

FIG. 6 is a flowchart illustrating an execution flow of image quality adjustment control in the present control example 1. In this control example 1, when an instruction to execute "image quality adjustment B" (image quality adjustment control A+B) is input (S11), the image quality adjustment unit 242 of the control unit 240 first acquires the elapsed time from the previous execution of image quality adjustment control A (when image quality adjustment control A is executed alone, when image quality adjustment control A included in "image quality adjustment B" is executed, etc.) from the elapsed time storage unit 251 of the storage unit 250 (S12).

Subsequently, the image quality adjustment unit 242 determines whether the acquired elapsed time is less than a specified time (for example, 60 minutes) (S13). If it is determined that the time is equal to or longer than the specified time (NO in S13), the image quality adjustment unit 242 outputs a command to execute the image quality adjustment control A to the image formation control unit 241 (S14). Accordingly, in the image formation control unit 241, the operation for the image quality adjustment control A is executed, and the image quality adjustment control A is performed.

The image quality adjustment unit 242 that has output the command to execute the image quality adjustment control A clears the elapsed time stored in the elapsed time storage unit 251 of the storage unit 250 and starts measuring the elapsed time again (S15).

When the image quality adjustment control A is completed, the image quality adjustment unit 242 outputs a command to execute the image quality adjustment control B to the image formation control unit 241 (S16). Accordingly, in the image formation control unit 241, the operation for the image quality adjustment control B is executed, and the image quality adjustment control B is performed.

On the other hand, when it is determined that the time is less than the specified time in the step S13 (YES in S13), the image quality adjustment unit 242 outputs a command to execute the image quality adjustment control B to the image formation control unit 241 without outputting a command to execute the image quality adjustment control A (S16). Accordingly, in the image formation control unit 241, the operation for the image quality adjustment control B is executed, and the image quality adjustment control B is performed.

According to the present control example 1, when the execution skip condition that the elapsed time from the previous execution of the image quality adjustment control A is less than the specified time is satisfied in executing the "image quality adjustment B" (image quality adjustment control A+B), the image formation control unit 241 executes only the image quality adjustment control B without executing the image quality adjustment control A. Accordingly, the image quality adjustment control A, which is not necessary to be executed because the elapsed time from the previous execution is short, is not performed. Thus, failures such as time loss, wasteful consumption of consumables, and deterioration of components during the execution of the "image quality adjustment B" can be restrained.

Control Example 2

Figure 7:
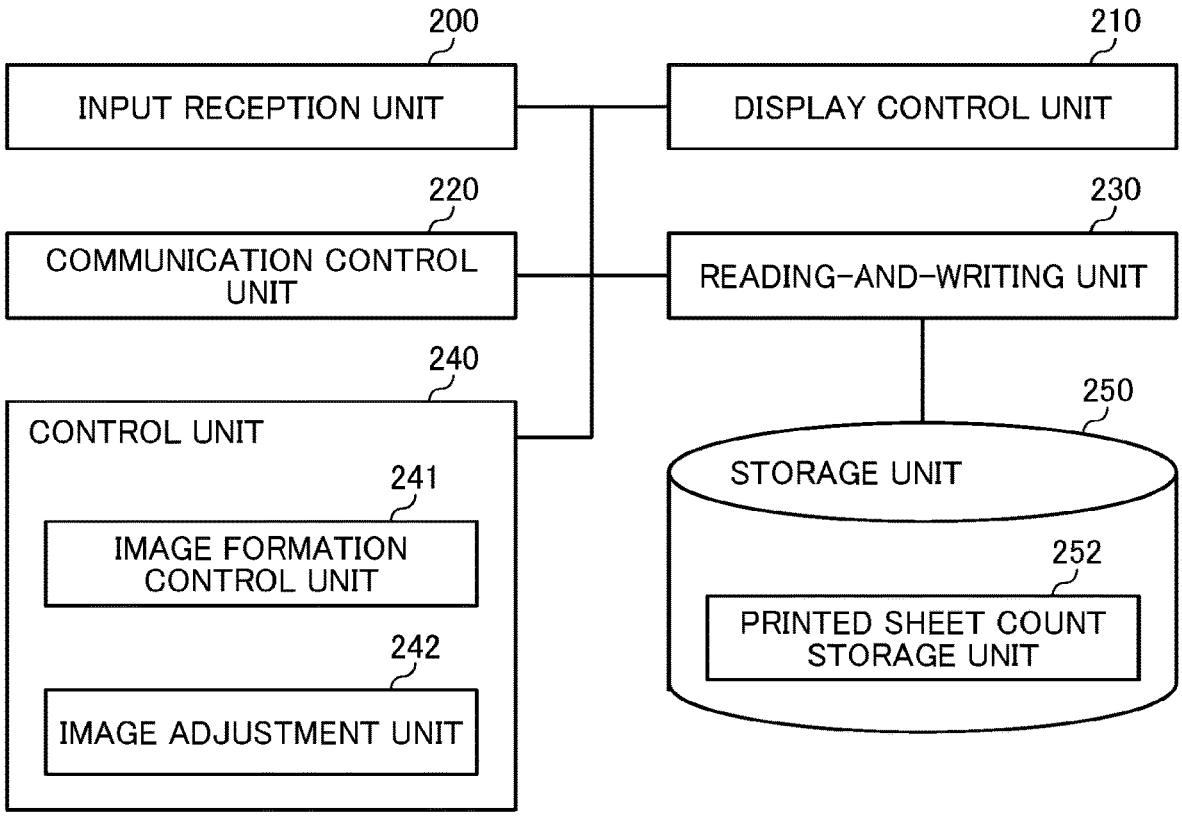
FIG. 7 is a functional block diagram relating to image quality adjustment control in a control example 2.

Next, a description is given of another control example (hereinafter, this control example is referred to as "control example 2") of the image quality adjustment control in the present embodiment. FIG. 7 is a functional block diagram relating to image quality adjustment control of the present control example 2. The functional block diagram of the control example 2 is similar to that of the control example 1 described above except that the printed sheet count storage unit 252 is included in the storage unit 250. The printed sheet count storage unit 252 stores the number of printed sheets counted since the last execution for each type of image quality adjustment control.

Figure 8:
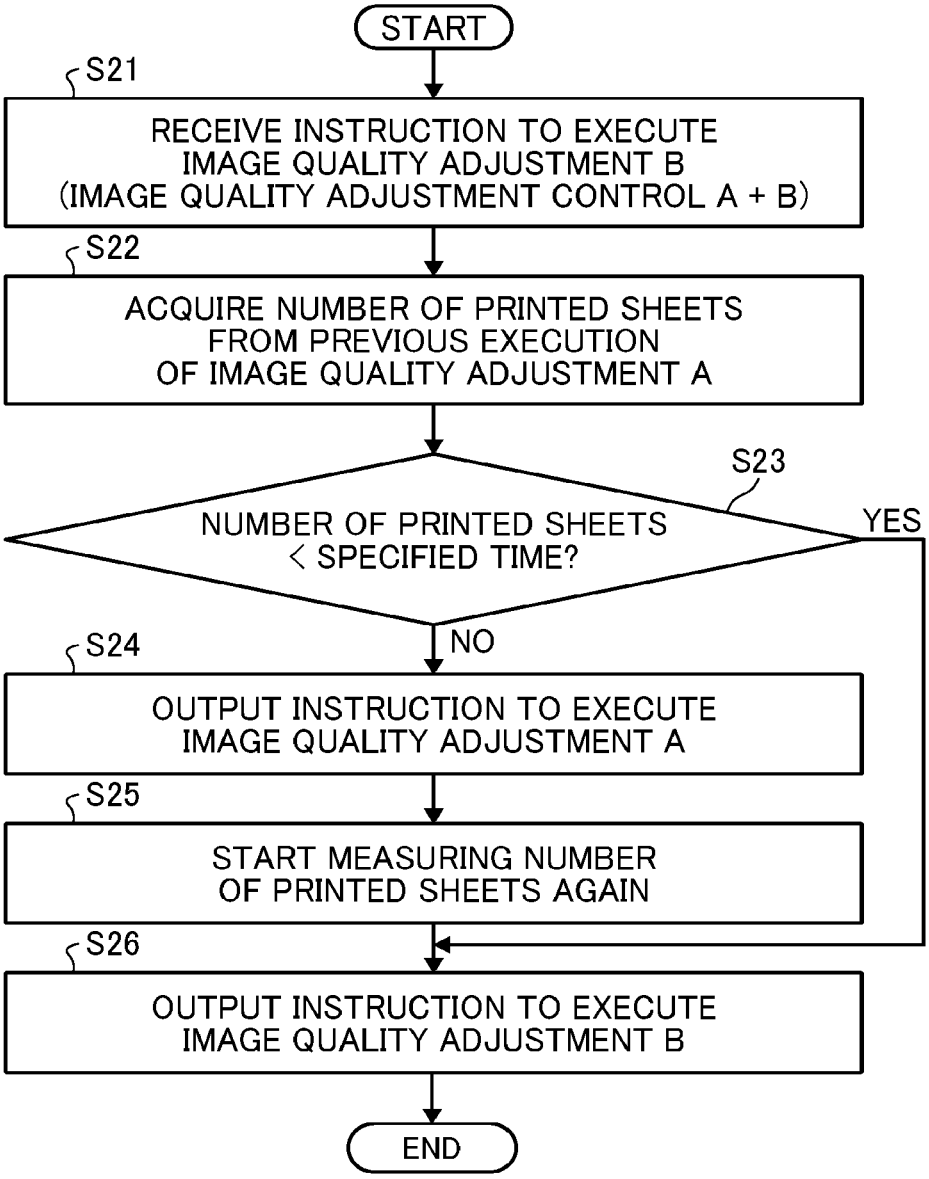
FIG. 8 is a flowchart illustrating an execution flow of the image quality adjustment control in the control example 2.

FIG. 8 is a flowchart illustrating an execution flow of image quality adjustment control in the present control example 2. The execution flow of the image quality adjustment control in the present control example 2 is substantially similar to the above-described control example. When an instruction to execute "image quality adjustment B" (image quality adjustment control A+B) is input (S21), the image quality adjustment unit 242 of the control unit 240 acquires, from the printed sheet count storage unit 252 of the storage unit 250, the number of printed sheets counted since the previous execution of the image quality adjustment control A (S22).

Subsequently, the image quality adjustment unit 242 determines whether the acquired number of printed sheets is less than a specified number (for example, 1000 sheets) (S23). If it is determined that the number of printed sheets is equal to or larger than the specified number (NO in S23), the image quality adjustment unit 242 outputs a command to execute image quality adjustment control A to the image formation control unit 241 (S24). Accordingly, in the image formation control unit 241, the operation for the image quality adjustment control A is executed, and the image quality adjustment control A is performed.

The image quality adjustment unit 242 that has output the command to execute the image quality adjustment control A clears the number of printed sheets stored in the printed sheet count storage unit 252 of the storage unit 250 and starts measuring an elapsed time again (S25).

When the image quality adjustment control A is completed, the image quality adjustment unit 242 outputs a command to execute the image quality adjustment control B to the image formation control unit 241 (S26). Accordingly, in the image formation control unit 241, the operation for the image quality adjustment control B is executed, and the image quality adjustment control B is performed.

On the other hand, when it is determined that the number of printed sheets is less than the specified number in the step S23 (YES in S23), the image quality adjustment unit 242 outputs a command to execute the image quality adjustment control B to the image formation control unit 241 without outputting a command to execute the image quality adjustment control A (S26). Accordingly, in the image formation control unit 241, the operation for the image quality adjustment control B is executed, and the image quality adjustment control B is performed.

According to the present control example 2, when the execution skip condition that the number of printed sheets counted from the previous execution of the image quality adjustment control A is less than the specified number is satisfied in executing the "image quality adjustment B" (image quality adjustment control A+B), the image formation control unit 241 executes only the image quality adjustment control B without executing the image quality adjustment control A. Accordingly, the image quality adjustment control A, which is not necessary to be executed because the number of printed sheets counted from the previous execution is small, is not performed. Thus, failures such as time loss, wasteful consumption of consumables, and deterioration of components during the execution of the "image quality adjustment B" can be restrained.

Control Example 3

Figure 9:
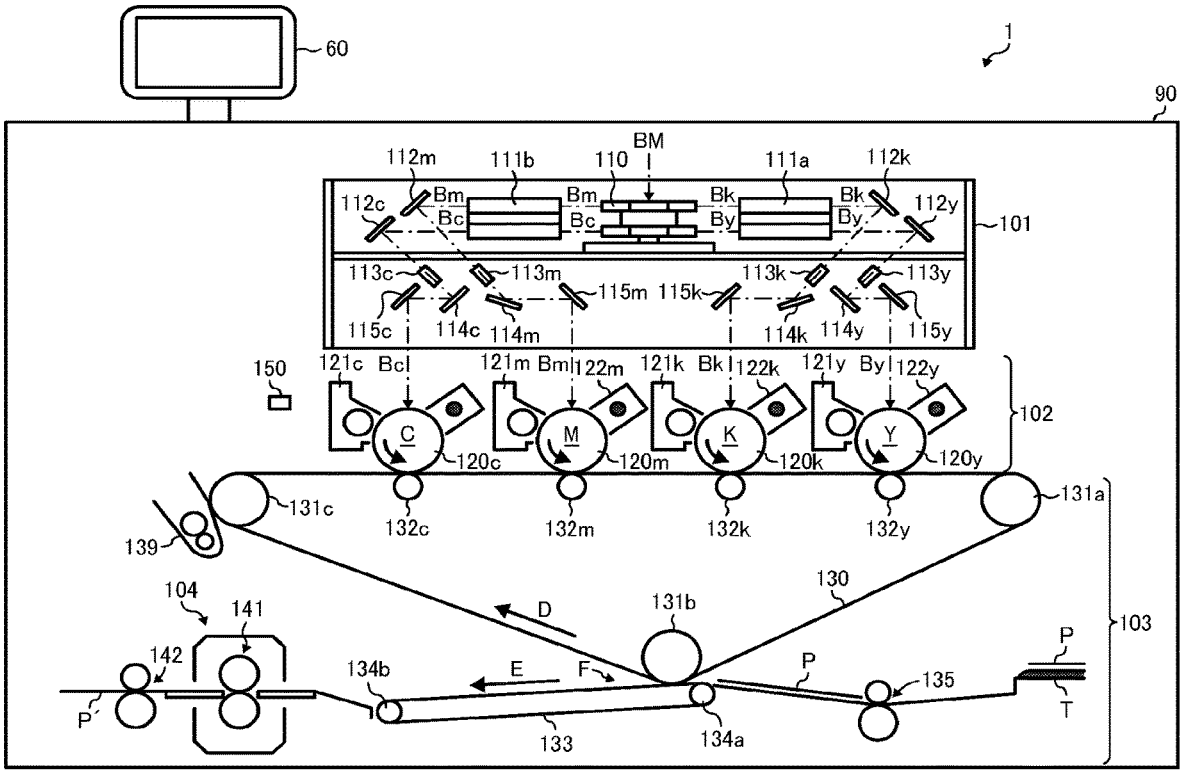
FIG. 9 is a schematic diagram illustrating a hardware configuration of a printer engine mounted with a temperature-and-humidity sensor used in a control example 3.

Next, a description is given of still another control example (hereinafter, this control example is referred to as "control example 3") of the image quality adjustment control in the present embodiment. FIG. 9 is a schematic diagram illustrating a hardware configuration of the printer engine 100 mounted with a temperature sensor, a humidity sensor, or a temperature-and-humidity sensor used in the control example 3. A temperature-and-humidity sensor 150 illustrated in FIG. 9 serves as a temperature detector and a humidity detector capable of detecting temperature and humidity (relative humidity in the present embodiment) in the vicinity of the image forming unit 102. Although the temperature-and-humidity sensor 150 is mounted in this example, only a temperature sensor or only a humidity sensor may be mounted. The installation position of the temperature-and-humidity sensor 150 illustrated in FIG. 9 is an example, and the installation position of the temperature-and-humidity sensor 150 is not limited to the position illustrated in FIG. 9.

Figure 10:
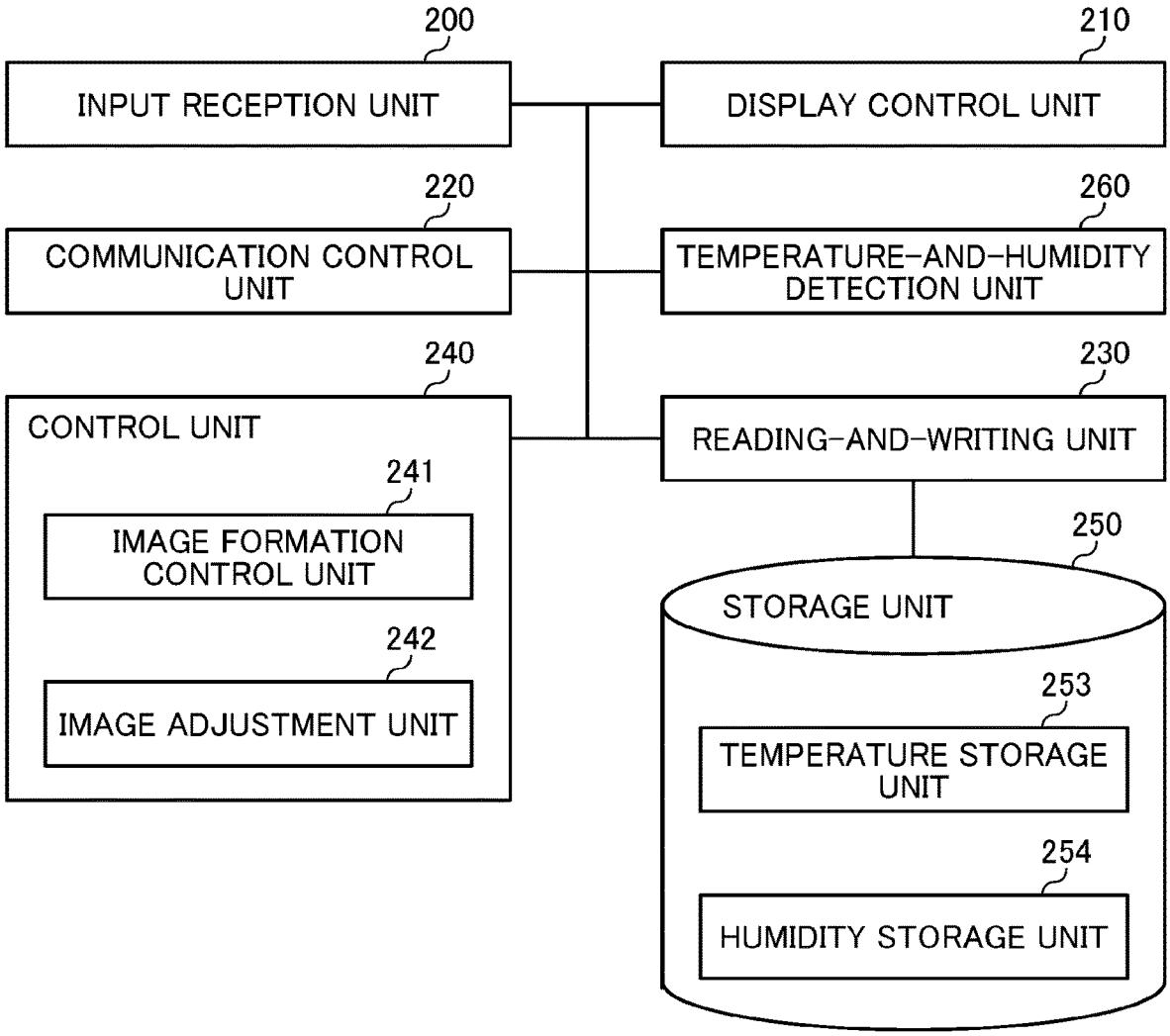
FIG. 10 is a functional block diagram relating to image quality adjustment control of a control example 3.

FIG. 10 is a functional block diagram relating to image quality adjustment control of the present control example 3. The functional block diagram of the control example 3 is similar to that of the control example 1 described above except that a temperature-and-humidity detection unit 260 is provided and a temperature storage unit 253 and a humidity storage unit 254 are included in the storage unit 250. The temperature-and-humidity detection unit 260 includes a temperature-and-humidity sensor 150. The temperature-and-humidity sensor 150 detects the temperature and humidity (hereinafter also referred to as "temperature-humidity") in the vicinity of the installation location. The temperature storage unit 253 and the humidity storage unit 254 of the storage unit 250 store the temperature and the humidity detected by the temperature-and-humidity sensor 150, respectively.

Figure 11:
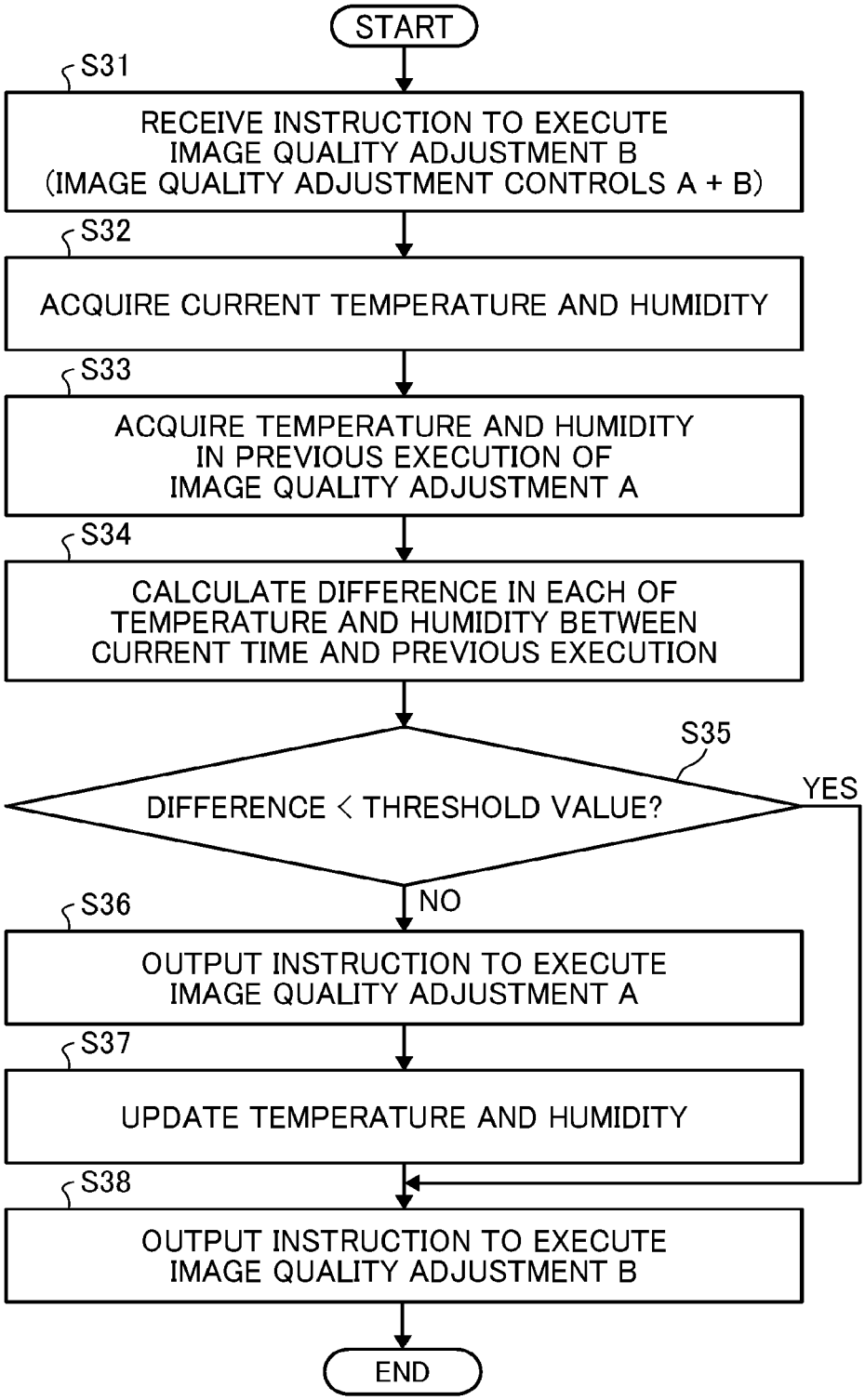
FIG. 11 is a flowchart illustrating an execution flow of the image quality adjustment control in the control example 3.

FIG. 11 is a flowchart illustrating an execution flow of image quality adjustment control in the present control example 3. In the control example 3, when an instruction to execute "image quality adjustment B" (image quality adjustment control A+B) is input (S31), the image quality adjustment unit 242 of the control unit 240 acquires the current temperature and humidity from the temperature-and-humidity detection unit 260 (S32). In addition, the image quality adjustment unit 242 acquires the temperature and the humidity at the time of the previous execution of the image quality adjustment control A from the temperature storage unit 253 and the humidity storage unit 254 of the storage unit 250 (S33). The image quality adjustment unit 242 calculates the difference between the current temperature and the temperature at the precious execution of the image quality adjustment control A, and the difference between the current humidity and the humidity at the precious execution of the image quality adjustment control A (S34).

Subsequently, the image quality adjustment unit 242 determines whether each calculated difference is equal to a threshold value (for example, 10° C. for temperature and 20% RH for humidity or, if the absolute humidity is used, for example, less than 7 g/m$^3$) (S35). If it is determined that any of the differences is equal to or larger than the threshold value (NO in S35), the image quality adjustment unit 242 outputs a command to execute image quality adjustment control A to the image formation control unit 241 (S36). Accordingly, in the image formation control unit 241, the operation for the image quality adjustment control A is executed, and the image quality adjustment control A is performed.

The image quality adjustment unit 242 that has output the command to execute the image quality adjustment control A updates the temperature and the humidity stored in the temperature storage unit 253 and the humidity storage unit 254 of the storage unit 250 to the current temperature and humidity, respectively (S37).

When the image quality adjustment control A is completed, the image quality adjustment unit 242 outputs a command to execute the image quality adjustment control B to the image formation control unit 241 (S38). Accordingly, in the image formation control unit 241, the operation for the image quality adjustment control B is executed, and the image quality adjustment control B is performed.

On the other hand, when it is determined that each calculated difference is less than the threshold value in the step S35 (YES in S35), the image quality adjustment unit 242 outputs a command to execute the image quality adjustment control B to the image formation control unit 241 without outputting a command to execute the image quality adjustment control A (S38). Accordingly, in the image formation control unit 241, the operation for the image quality adjustment control B is executed, and the image quality adjustment control B is performed.

According to the control example 3, if the execution skip condition that the difference between the current temperature and humidity and the temperature and humidity at the time of the previous execution of the image quality adjustment control A is less than the threshold value is satisfied in executing the "image quality adjustment B" (image quality adjustment control A+B), the image formation control unit 241 executes only the image quality adjustment control B without executing the image quality adjustment control A. Accordingly, the image quality adjustment control A, which is not necessary to be executed because changes in temperature and humidity from the previous execution is small, is not performed. Thus, failures such as time loss, wasteful consumption of consumables, and deterioration of components during the execution of the "image quality adjustment B" can be restrained.

In the control example 3, both of the temperature and the humidity are used to determine the execution skip condition. However, in some embodiments, any one of the temperature and the humidity may be used. In the control example 3, when one of the temperature and the humidity satisfies the execution skip condition, only the image quality adjustment control B is executed without executing the image quality adjustment control A. However, in some embodiments, when both of the temperature and the humidity satisfy the execution skip conditions, only the image quality adjustment control B may be executed without executing the image quality adjustment control A.

At least two of the control examples 1 to 3 described above may be combined. As for the execution skip condition, for example, when either or both of the execution skip condition that the elapsed time is less than the specified time (60 minutes) and the execution skip condition that the number of printed sheets is less than the specified number of sheets (1000 sheets) are satisfied, only the image quality adjustment control B may be executed without executing the image quality adjustment control A. Further, for example, when one or both of the execution skip condition that the elapsed time is less than the specified time (60 minutes) and the execution skip condition that the difference between the absolute humidities is less than the threshold (7 g/m$^3$) are satisfied, only the image quality adjustment control B may be executed without executing the image quality adjustment control A.

Image Quality Adjustment Control Example 1

Next, an example of image quality adjustment control in the present embodiment (hereinafter referred to as "image quality adjustment control example 1") is described. As illustrated in FIG. 2, the image forming apparatus 1 according to the present embodiment includes a toner adhesion amount sensor 160 as a toner adhesion amount detector that detects the toner adhesion amount of a toner image (in other words, density of a toner image) formed on the outer peripheral surface of the intermediate transfer belt 130. The toner adhesion amount sensor 160 according to the present embodiment is an optical sensor unit including an optical sensor and the like. In the present embodiment, the toner adhesion amount sensor 160 is provided in the vicinity of the intermediate transfer belt 130. Toner images of predetermined image patterns formed on the photoconductors 120*c*, 120*m*, 120*k*, and 120*y* are transferred onto the intermediate transfer belt 130, and the toner adhesion amount sensor 160 detects the toner adhesion amounts (densities) of the toner images of the respective colors.

In the image quality adjustment control example 1, the image forming condition is determined based on the detection result of the toner adhesion amount (density) detected on the intermediate transfer belt 130. In the present embodiment, the toner adhesion amount sensor 160 is provided in the vicinity of the intermediate transfer belt 130. However, in some embodiments, the toner adhesion amount sensor 160 may be provided in the vicinity of each of the photoconductors 120*c*, 120*m*, 120*k*, and 120*y* or in the vicinity of the secondary transfer belt 133 to detect the toner adhesion amount of the toner image borne on each of the photoconductors 120*c*, 120*m*, 120*k*, and 120*y*.

Figure 12A:
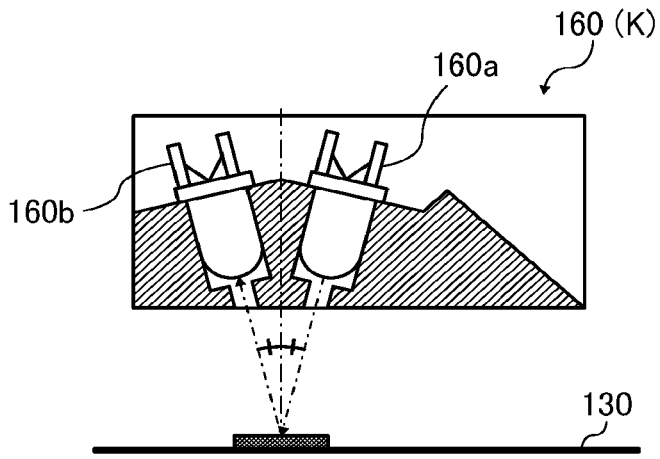
FIG. 12A is a schematic diagram illustrating an example of a black toner adhesion amount sensor.
Figure 12B:
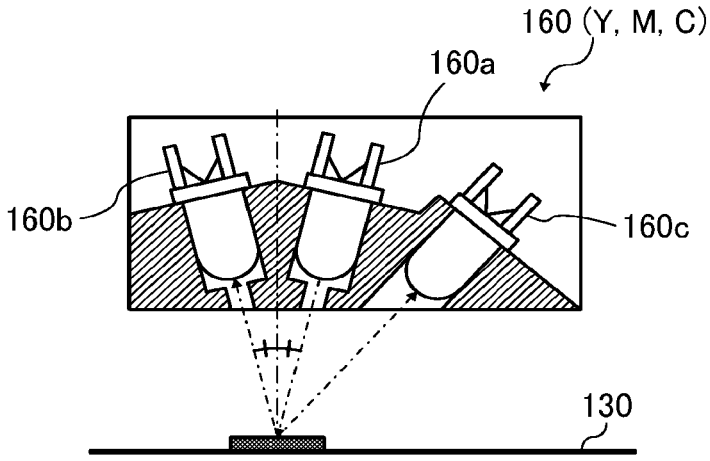
FIG. 12B is a schematic diagram illustrating an example of a color toner adhesion amount sensor.
Figure 13:
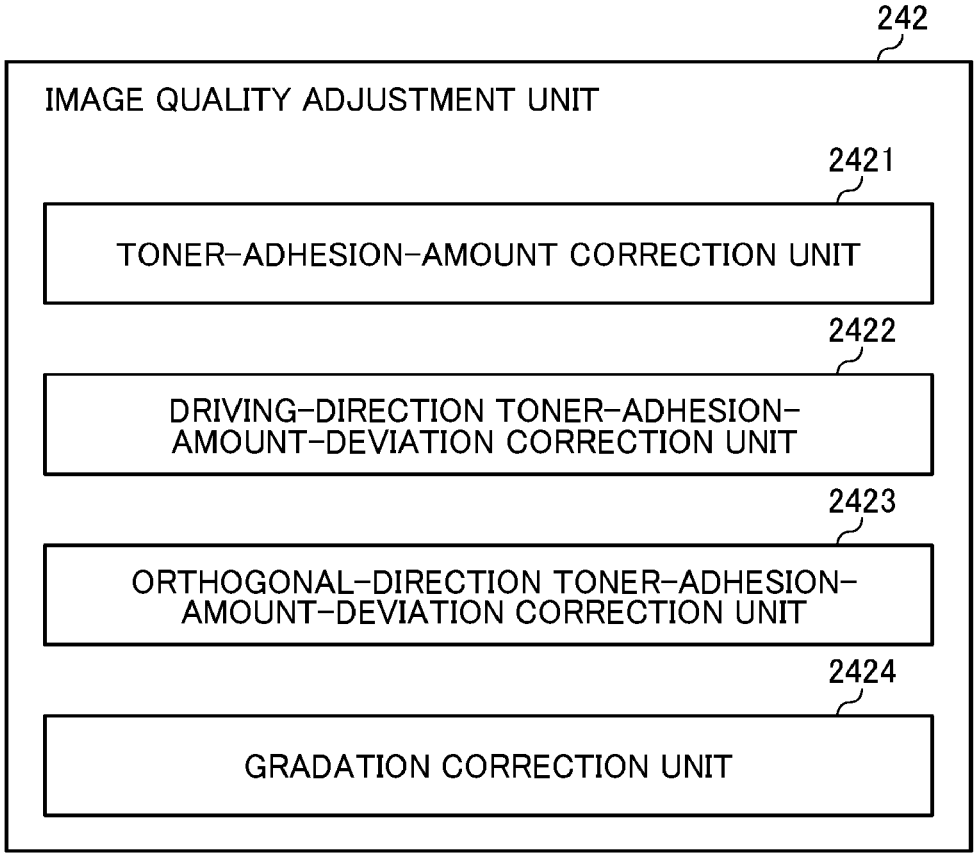
FIG. 13 is a functional block diagram of an image quality adjustment unit in an image quality adjustment control example 1.

FIGS. 12A and 12B are schematic views illustrating examples of the toner adhesion amount sensor 160. FIG. 12A illustrates a black toner adhesion amount sensor 160 (K) suitable for detecting the toner adhesion amount (density) of the black toner image. FIG. 13 B illustrates color toner adhesion amount sensors 160 (Y, M, and C) suitable for detecting the toner adhesion amounts (densities) of the color toner images other than the black toner image.

The black toner adhesion amount sensor 160 (K) illustrated in FIG. 12A includes a light emitting element 160*a* including a light emitting diode (LED) or the like and a light receiving element 160*b* that receives specular reflection light. The light emitting element 160*a* emits light onto the intermediate transfer belt 130, and the emitted light is reflected by the surfaces of the intermediate transfer belt 130 and the toner. The light receiving element 160*b* receives specular reflection light among the reflection light.

The color toner adhesion amount sensor 160 (Y, M, or C) illustrated in FIG. 12B includes a light emitting element 160*a* including a light emitting diode (LED) or the like, a light receiving element 160*b* that receives specular reflection light, and a light receiving element 160*c* that receives diffuse reflection light. As in the case of the black toner adhesion amount sensor 160 (K), the light emitting element 160*a* emits light onto the intermediate transfer belt 130, and the emitted light is reflected by the surfaces of the intermediate transfer belt 130 and the toner. The specular reflection light receiving element 160*b* receives specular reflection light of the reflection light, and the diffuse reflection light receiving element 160*c* receives diffuse reflection light of the reflection light.

In the present embodiment, a GaAs infrared light emitting diode in which the peak wavelength of emitted light is 950 nm is used as the light emitting element, and a silicon phototransistor in which the peak light receiving sensitivity is 800 nm is used as the light receiving element. In some embodiments, the light-emitting element and the light-receiving element may have different peak wavelengths and peak light-receiving sensitivities. Each of the black toner adhesion amount sensor 160 (K) and the color toner adhesion amount sensors 160 (Y, M, and C) is disposed at a distance (detection distance) of, for example, about 5 mm from the belt surface of the intermediate transfer belt 130 on which a toner image as a detection target is borne.

Outputs from the black toner adhesion amount sensors 160 (K) and the color toner adhesion amount sensors 160 (Y, M, and C) are converted into toner adhesion amounts by an adhesion amount conversion algorithm. As the adhesion amount conversion algorithm, an algorithm similar to a conventional algorithm can be used.

FIG. 13 is a functional block diagram of the image quality adjustment unit 242 in the image quality adjustment control example 1. The image quality adjustment unit 242 of the image quality adjustment control example 1 includes a toner-adhesion-amount correction unit 2421, a driving-direction toner-adhesion-amount-deviation correction unit 2422, a orthogonal-direction toner-adhesion-amount-deviation correction unit 2423, and a gradation correction unit 2424. Some or all of these functions can be executed by user instructions from the operation panel 60.

When there is a difference between the target value of the toner adhesion amount and the actual toner adhesion amount, the toner-adhesion-amount correction unit 2421 executes control for correcting the difference in the toner adhesion amount. Specifically, the toner-adhesion-amount correction unit 2421 outputs a command for correcting the difference in the toner adhesion amount to the image formation control unit 241 based on the detection result of a toner-adhesion-amount correction pattern formed on the intermediate transfer belt 130 detected by the toner adhesion amount sensor 160. Examples of the command for correcting the difference in toner adhesion amount include, but are not limited to, a command for adjusting the toner concentration of the developer in the developing device, a command for adjusting the developing bias or the charging bias, a command for adjusting the writing light amount, and a command for displaying on the operation panel 60 that the difference in toner adhesion amount has occurred.

The driving-direction toner-adhesion-amount-deviation correction unit 2422 executes control for correcting the deviation in the toner adhesion amount (deviation of toner adhesion amount in the driving direction) when the deviation in the toner adhesion amount of a toner image formed on the intermediate transfer belt 130 occurs in the driving direction of the intermediate transfer belt 130 (movement direction of the surface of the intermediate transfer belt), that is, in the sub-scanning direction. Specifically, the driving-direction toner-adhesion-amount-deviation correction unit 2422 outputs a command for correcting the deviation in the toner adhesion amount in the driving direction to the image formation control unit 241 based on the detection result of the driving-direction toner-adhesion-amount-deviation correction pattern formed on the intermediate transfer belt 130 detected by the toner adhesion amount sensor 160.

Examples of the command for correcting the deviation in the toner adhesion amount in the driving direction includes, but are not limited to, a command for adjusting the toner concentration of the developer in the developing device (e g, increasing the toner concentration in the developer so that the toner on the developing roller does not run short); a command for adjusting a developing bias or the charging bias (e.g., adjusting the developing bias or the charging bias so as to provide a developing potential that cancels the deviation); a command for adjusting the amount of writing light (e.g., controlling the amount of writing light so as to provide a developing potential that cancels the deviation); and a command for displaying on the operation panel 60 that there is a deviation in the toner adhesion amount in the driving direction.

The orthogonal-direction toner-adhesion-amount-deviation correction unit 2423 executes control for correcting the deviation in the toner adhesion amount (orthogonal-direction toner adhesion amount deviation) when the deviation in the toner adhesion amount of the image formed on the intermediate transfer belt 130 occurs in a direction (orthogonal direction) orthogonal to the driving direction of the intermediate transfer belt 130, that is, in the main scanning direction. Specifically, the orthogonal-direction toner-adhesion-amount-deviation correction unit 2423 outputs a command for correcting the orthogonal-direction toner adhesion amount deviation to the image formation control unit 241 based on an orthogonal-direction toner-adhesion-amount-deviation correction pattern formed on the intermediate transfer belt 130 detected by the toner adhesion amount sensor 160. Similar to the command for correcting the deviation of the toner adhesion amount in the driving direction, examples of the command for correcting the deviation of the toner adhesion amount in the orthogonal direction include, but are not limited to, a command for adjusting the toner concentration of the developer in the developing device, a command for adjusting the developing bias and the charging bias, a command for adjusting the writing light amount, and a command for displaying on the operation panel 60 that there is a deviation in the toner adhesion amount in the orthogonal direction.

When an abnormality occurs in the gradation of a toner image formed on the intermediate transfer belt 130, the gradation correction unit 2424 executes control for correcting the gradation. Specifically, the gradation correction unit 2424 outputs a command for correcting the gradation to the image formation control unit 241 based on the detection result of the gradation correction (calibration) pattern formed on the intermediate transfer belt 130 detected by the toner adhesion amount sensor 160. Examples of the command for correcting the gradation include, but are not limited to, a command for adjusting the toner concentration of the developer in the developing device, a command for adjusting the developing bias or the charging bias, a command for adjusting the amount of writing light, and a command for displaying the occurrence of the gradation abnormality on the operation panel 60.

In the image quality adjustment control example 1, for example, before the correction of the deviation of the toner adhesion amount in the driving direction or the correction of the deviation of the toner adhesion amount in the orthogonal direction is performed, it is desirable that the toner adhesion amount is controlled to be within a target range, that is, it is desirable that the correction of the toner adhesion amount is performed in advance. In such a case, the correction of the toner adhesion amount corresponds to the image quality adjustment control A described above, and the correction of the deviation of the toner adhesion amount in the driving direction or the correction of the deviation of the toner adhesion amount in the orthogonal direction corresponds to the image quality adjustment control B.

In such a case, for example, when the print job is finished and the user finds the occurrence of image density unevenness in the driving direction in the output image, the user performs a command operation for executing the correction of the image density unevenness (image quality adjustment control B) by using the driving-direction toner-adhesion-amount-deviation correction function. At this time, the user does not necessarily give an instruction to execute the toner adhesion amount correction (image quality adjustment control A) before executing the driving-direction toner-adhesion-amount-deviation correction. On the other hand, a control mode (second control mode) is provided in which the toner adhesion amount correction (image quality adjustment control A) is always performed before the driving-direction toner-adhesion-amount-deviation correction (image quality adjustment control B) and the orthogonal-direction toner-adhesion-amount-deviation correction (image quality adjustment control B) are performed. In such a case, for example, as in the following cases, the toner adhesion amount correction (image quality adjustment control A) that is not required to be performed may be performed in executing the control mode. Consequently, an increase in downtime, wasteful toner consumption, developer deterioration, and the like may be caused.

For example, the correction of the toner adhesion amount is programmed to be automatically executed for each printing of a predetermined number of sheets and the correction of the toner adhesion amount is automatically executed after the print job is finished. In such a case, even if the user executes the correction of the deviation of the toner adhesion amount in the driving direction once, the deviation may not be completely corrected and the user may continuously execute the correction of the deviation of the toner adhesion amount in the orthogonal direction. In this case, for example, if the user once executes the driving-direction toner-adhesion-amount-deviation correction and recognizes that the toner adhesion amount deviation in the driving direction has been eliminated and thus the deviation has occurred in the toner adhesion amount in the orthogonal direction, the user may subsequently execute the orthogonal-direction toner-adhesion-amount-deviation correction.

According to the present embodiment, even in such a case, the execution of the toner adhesion amount correction that is not required to be executed can be restrained. Such a configuration can restrain an increase in downtime, wasteful toner consumption, deterioration of the developer, and the like due to the execution of the toner adhesion amount correction that is not necessary to be executed.

The combination of the image quality adjustment control A and the image quality adjustment control B is not limited to that described above. For example, it may be desirable not only to control the toner adhesion amount within the target range but also to eliminate the deviations of the toner adhesion amount in the driving direction and the orthogonal direction before performing the gradation correction. This is because patches having different gradations in the driving direction and the orthogonal direction are formed. When a deviation of the toner adhesion amount occurs in the driving direction or the orthogonal direction due, correct gradation may not be expressed and the correction may fail. In such a case, at least one of the toner adhesion amount correction, the driving-direction toner-adhesion-amount-deviation correction, and the orthogonal-direction toner-adhesion-amount-deviation correction corresponds to the image quality adjustment control A described above, and the gradation correction corresponds to the image quality adjustment control B.

Further, if the gradation correction and other image quality adjustment controls (the toner adhesion amount and the deviation of the toner adhesion amount in the driving direction and the orthogonal direction) are completely independent of each other, the user might forget to instruct the other image quality adjustment controls to be executed before the gradation correction. In other words, in such a case, for example, when a gradation occurs during printing of the same image and gradation correction is performed, the user needs to determine in advance which image quality adjustment control is to be performed, which might cause a disadvantage in which the work becomes complicated. In the present embodiment, the above-described configuration can prevent such a disadvantage.

For example, when the gradation correction of various images is collectively performed, the other necessary image quality adjustment may be performed in advance only when the first gradation correction is performed, and only the gradation correction may be performed in the second and subsequent gradation corrections. In addition, when a gradation deviation occurs during printing of the same image, the image forming apparatus 1 determines the necessity of executing the image quality adjustment control in advance according to the elapsed time, the number of printed sheets, the change in temperature and humidity, and the like when the gradation correction command is received.

Figure 14A:
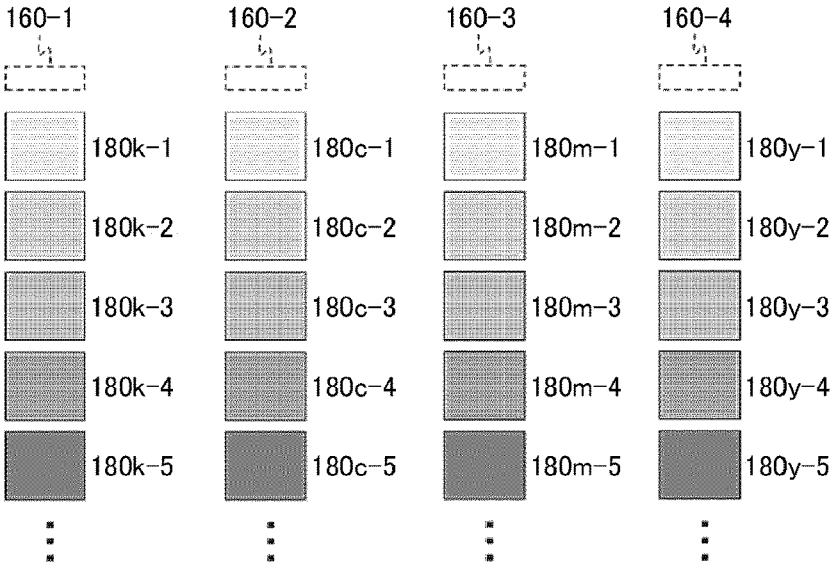
FIGS. 14A, 14B, and 14C are illustrations of examples of correction patterns formed on an intermediate transfer belt, which are used for image quality adjustment controls.
Figure 14B:
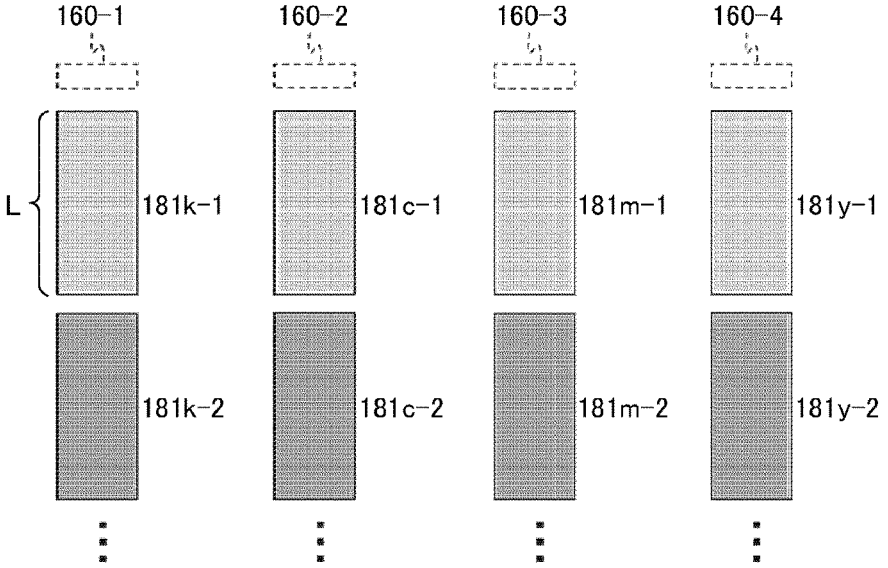
Figure 14C:
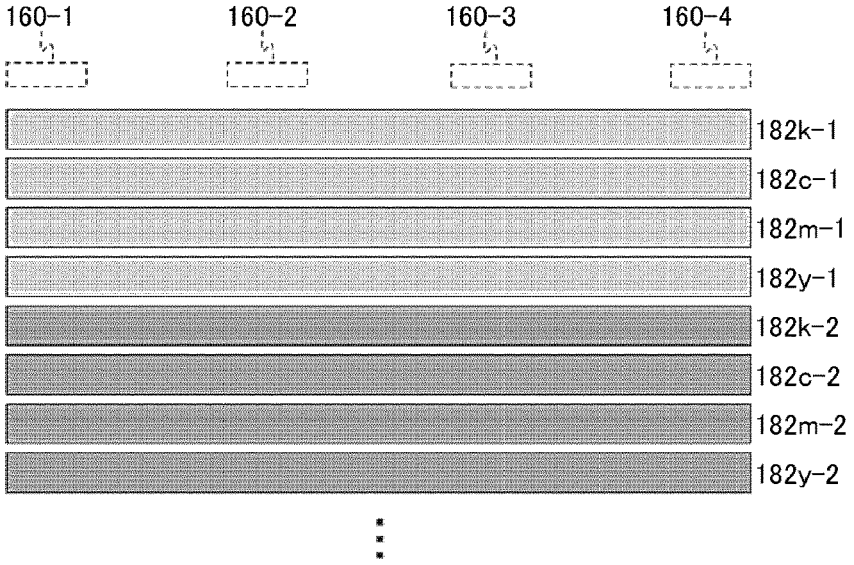

FIGS. 14A, 14B, and 14C are illustrations of examples of correction patterns formed on the intermediate transfer belt 130 and used for image quality adjustment controls. FIGS. 14A, 14B, and 14C, four toner adhesion amount sensors 160 are arranged in the main scanning direction. Note that the number and arrangement of the toner adhesion amount sensors 160 are not limited to the example illustrated in FIGS. 14A, 14B, and 14C.

As the toner-adhesion-amount correction pattern and the gradation correction pattern, for example, as illustrated in FIG. 14A, patterns in which gradation patches of K, C, M, and Y are formed in a stepwise manner can be used. FIG. 14A illustrates an example in which the patches of K, C, M, and Y are simultaneously formed with the same gradation. Note that the shape, number, layout, and the like of the formed patches are not limited thereto. The shape, gradation, and layout of patches may be different between the toner-adhesion-amount correction pattern and the gradation correction pattern.

As the driving-direction toner-adhesion-amount-deviation correction pattern, for example, as illustrated in FIG. 14B, a pattern can be used in which patches of K, C, M, and Y having long shapes in the driving direction are formed. The length of the patch is preferably longer than the circumferential length of the photoconductor, for example. FIG. 14B illustrates an example in which the patches of K, C, M, and Y are simultaneously formed with the same gradation. Note that the shape, layout, and the like of the formed patches are not limited thereto.

For example, as illustrated in FIG. 14C, a pattern in which patches of K, C, M, and Y having long shapes in the direction (orthogonal direction) orthogonal to the driving direction are formed can be used as the orthogonal-direction toner-adhesion-amount-deviation correction pattern. FIG. 14C illustrates an example in which the patches of K, C, M, and Y are formed with the same gradation. Note that the shape, layout, and the like of the formed patches are not limited thereto.

Image Quality Adjustment Control Example 2

Next, a description is given of another example of the image quality adjustment control (hereinafter referred to as "image quality adjustment control example 2"). As illustrated in FIG. 2, the image forming apparatus 1 according to the present embodiment includes the image density sensor 170 as an image density detector that detects the image density on the sheet P' discharged from the fixing device 104. The image density sensor 170 according to the present embodiment is an optical sensor unit that can detect image density for each color corresponding to a toner color and includes an optical sensor or the like. In the present embodiment, the toner adhesion amount sensor 160 is provided in the vicinity of the intermediate transfer belt 130. Toner images of predetermined image patterns formed on the photoconductors 120*c*, 120*m*, 120*k*, and 120*y* are transferred onto the intermediate transfer belt 130, and the toner adhesion amount sensor 160 detects the toner adhesion amounts (densities) of the toner images of the respective colors.

In the image quality adjustment control example 2, the image forming condition is determined based on the detection result of the image density detected on the sheet P'. The image density sensor 170 in the present embodiment is disposed downstream from the fixing device in the sheet conveyance direction. Note that, in some embodiments, the image density sensor 170 may be disposed near the intermediate transfer belt 130 or near the secondary transfer belt 133 on the upstream side of the fixing device in the sheet conveyance direction.

Figure 15:
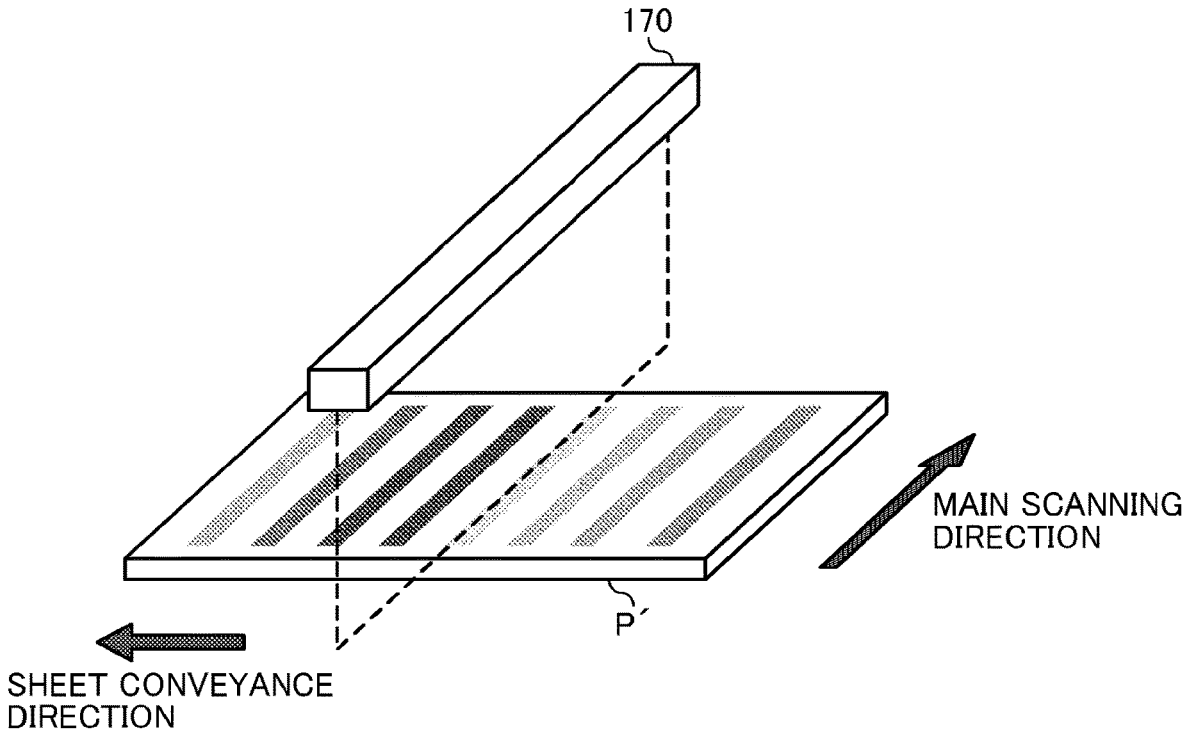
FIG. 15 is a perspective view illustrating an example of an image density sensor.

FIG. 15 is a perspective view illustrating an example of the image density sensor 170. As illustrated in FIG. 15, the image density sensor 170 is a line sensor elongated in the main scanning direction, and an image element elongated in the main scanning direction is provided inside the image density sensor 170. The detection width of the image density sensor 170 in the main scanning direction is a width indicated by a broken line in the main scanning direction in FIG. 15. The detection width is longer than the width of the sheet P' in the main scanning direction. Accordingly, when the sheet P' is conveyed so as to pass through the width indicated by the broken line in the main scanning direction, the image density can be detected over the entire area of the sheet P'. In other words, the image density sensor 170 in FIG. 15 can also detect the density of the right end portion, the left end portion, the leading end portion in the sheet conveyance direction, and the trailing end portion in the sheet conveyance direction of the sheet P'. FIG. 15 illustrates an example of the image density sensor 170 in which the detection width in the main scanning direction is longer than the width of the sheet P' in the main scanning direction. Note that the detection width is not limited thereto, and for example, a detection width shorter than the width of the sheet P' in the main scanning direction may be used.

Figure 16A:
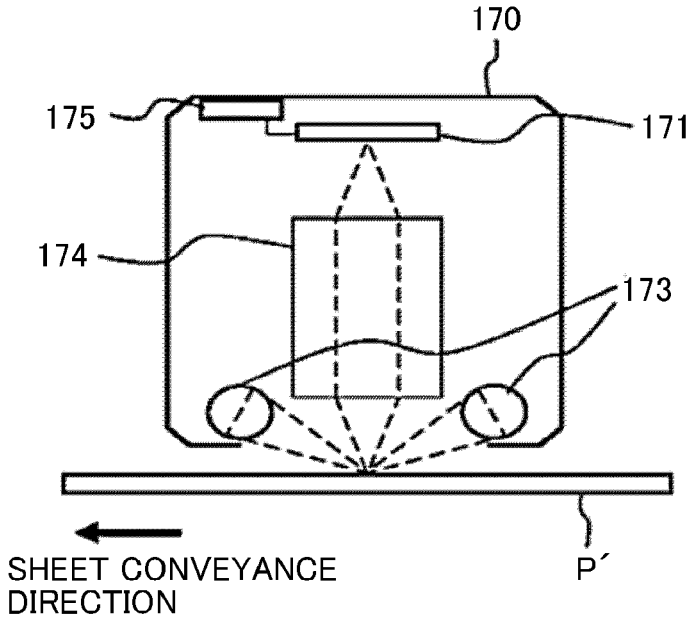
FIG. 16A is a cross-sectional view of the image density sensor of FIG. 15 taken along a cross section orthogonal to a main scanning direction.

FIG. 16A is a cross-sectional view of the image density sensor 170 taken along a cross section orthogonal to the main scanning direction. As illustrated in FIG. 16A, the image density sensor 170 includes an image element 171, a light source 173, a lens array 174, and an output circuit 175. A broken line represents light emitted from the light source 173.

Figure 16B:
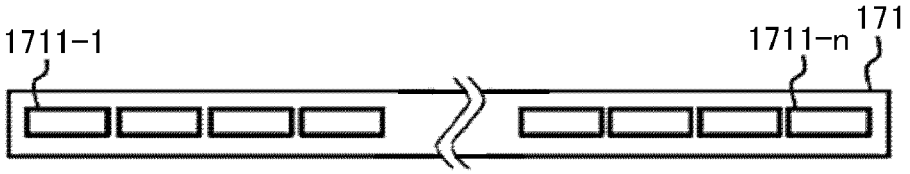
FIG. 16B is a schematic configuration diagram of an image element included in the image density sensor of FIG. 15.

FIG. 16B is a schematic diagram of a configuration of an image element included in the image density sensor 170. As illustrated in FIG. 16B, the image element 171 has a shape extending in the main scanning direction, and includes small light receiving elements 1711-1 to 1711-*n* (hereinafter referred to as light receiving elements 1711 unless distinguished from each other) arranged side by side in the main scanning direction. The range in which the light receiving elements 1711 are arranged is the detection width of the image density sensor 170 in the main scanning direction.

As the light source 173, a light source in which a light emitting element is provided at an end portion of a light guide body, an LED array, or the like can be used. The light source 173 emits RGB light. As the lens array 174, for example, a SELFOC (registered trademark) lens is used. The light emitted from the light source 173 is reflected on the sheet P' and is imaged by the lens array 174. The image element 171 receives the light imaged by the lens array 174 by each light receiving element 1711 illustrated in FIG. 16B, and outputs a signal corresponding to the received light. A complementary metal oxide semiconductor (CMOS) sensor or a charge-coupled device (CCD) sensor, for example, may be used as the image element 171.

The output circuit 175 includes, for example, an application specific integrated circuit (ASIC), and converts the signal from each light receiving element 172 on the image element 171 into data indicating image density corresponding to the position of an image pattern on the sheet P' and outputs the data. For example, 0 to 255 gradations represented by 8 bits are output.

Figure 17:
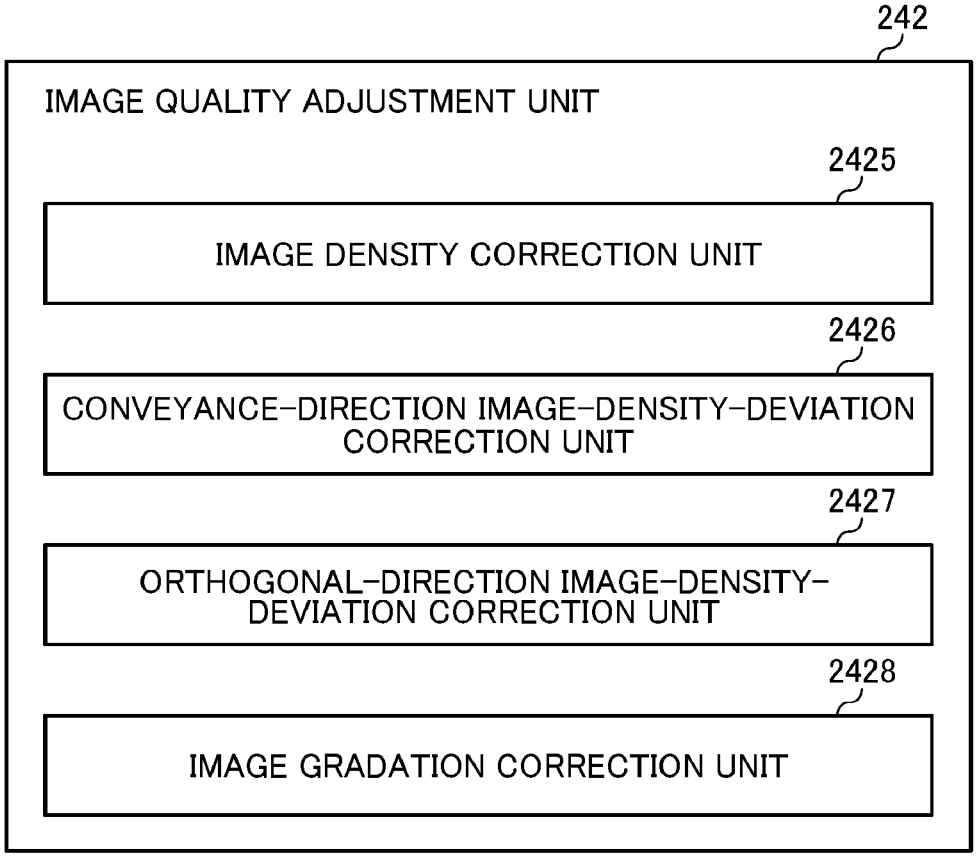
FIG. 17 is a functional block diagram of an image quality adjustment unit in an image quality adjustment control example 2.

FIG. 17 is a functional block diagram of the image quality adjustment unit 242 in the image quality adjustment control example 2. The image quality adjustment unit 242 of the image quality adjustment control example 2 includes an image density correction unit 2425, a conveyance-direction image-density-deviation correction unit 2426, an orthogonal-direction image-density-deviation correction unit 2427, and an image gradation correction unit 2428. Some or all of these functions can be executed by user instructions from the operation panel 60.

When a difference occurs between the image density target value and the actual image density, the image density correction unit 2425 executes control for correcting the image density difference. Specifically, the image density correction unit 2425 outputs a command for correcting the image density difference to the image formation control unit 241 based on the detection result of an image density correction pattern formed on a sheet P' detected by the image density sensor 170. Examples of the command for correcting the image density difference include, but are not limited to, a command for adjusting the toner concentration of the developer in the developing device, a command for adjusting the developing bias or the charging bias, a command for adjusting the amount of writing light, a command for changing the secondary transfer bias, a command for changing the fixing temperature, and a command for displaying on the operation panel 60 that the image density deviation occurs.

The conveyance-direction image-density-deviation correction unit 2426 executes control for correcting the image density deviation when the image density deviation of the image formed on the sheet P' occurs in the conveyance direction of the sheet P, in other words, in the sub-scanning direction. Specifically, the conveyance-direction image-density-deviation correction unit 2426 outputs a command for correcting the image density deviation to the image formation control unit 241 based on the detection result of a conveyance-direction image-density-deviation correction pattern formed on the sheet P detected by the image density sensor 170. Similar to the command for correcting the deviation of the toner adhesion amount in the driving direction in the image quality correction control example 1 described above, examples of the command for correcting the deviation of the image density include, but are not limited to, a command for adjusting the toner concentration of the developer in the developing device, a command for adjusting the developing bias or the charging bias, a command for adjusting the writing light amount, and a command for displaying on the operation panel 60 that a deviation occurs in the image density in the conveyance direction.

The orthogonal-direction image-density-deviation correction unit 2427 executes control for correcting the image density deviation when the image density deviation of the image formed on the sheet P' occurs in the direction (orthogonal direction) orthogonal to the conveyance direction of the sheet P, in other words, in the main scanning direction. Specifically, the orthogonal-direction image-density-deviation correction unit 2427 outputs a command for correcting the image density deviation to the image formation control unit 241 based on the detection result of an orthogonal-direction image-density-deviation correction pattern formed on the sheet P detected by the image density sensor 170. Similar to the command for correcting the orthogonal-direction toner-adhesion-amount deviation in the image quality correction control example 1 described above, examples of the command for correcting the deviation of the image density include, but are not limited to, a command for adjusting the toner concentration of the developer in the developing device, a command for adjusting the developing bias or the charging bias, a command for adjusting the writing light amount, and a command for displaying on the operation panel 60 that a deviation occurs in the image density in the orthogonal direction.

The image gradation correction unit 2428 executes control for correcting the gradation when an abnormality occurs in the gradation of an image formed on the sheet P'. Specifically, the image gradation correction unit 2428 outputs a command for correcting the gradation to the image formation control unit 241 based on the detection result of an image gradation correction (calibration) pattern formed on the sheet P detected by the image density sensor 170. Similar to the command for the gradation correction in the image quality correction control example 1 described above, examples of the command for correcting the gradation include, but is not limited to, a command for adjusting the toner concentration of the developer in the developing device, a command for adjusting the developing bias or the charging bias, a command for adjusting the writing light amount, and a command for displaying on the operation panel 60 that an abnormality occurs in the gradation.

Also in the present image quality adjustment control example 2, as in the case of the present image quality adjustment control example 1, failures such as time loss during execution of "image quality adjustment B", wasteful consumption of consumables, and component deterioration can be restrained.

FIGS. 18A to 18D are illustrations of examples of correction patterns formed on a sheet P', which are used for image quality adjustment controls.

Figure 18A:
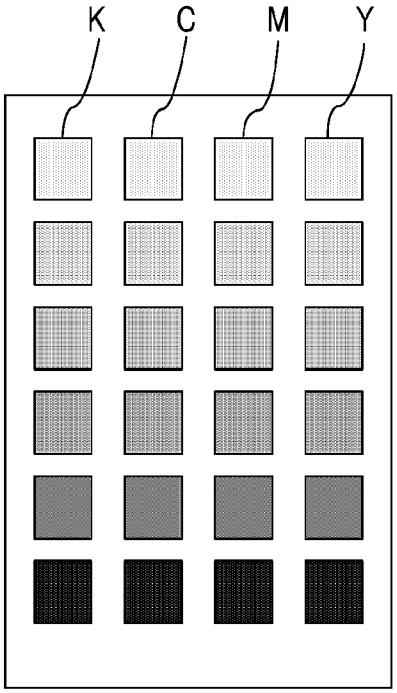
FIGS. 18A, 18B, 18C, and 18D are illustrations of examples of correction patterns formed on a sheet, which are used for image quality adjustment controls.

As the image density correction pattern or the image gradation correction pattern, for example, as illustrated in FIG. 18A, a pattern in which gradation patches of K, C, M, and Y are formed in a stepwise manner can be used. FIG. 18A illustrates an example in which the patches of K, C, M, and Y are simultaneously formed with the same gradation. Note that the shape, number, layout, and the like of the formed patches are not limited thereto. For example, the number of output sheets may be two or more. The shape, number, gradation, and layout of patches may be different between the image density correction pattern and the image gradation correction pattern.

Figure 18B:
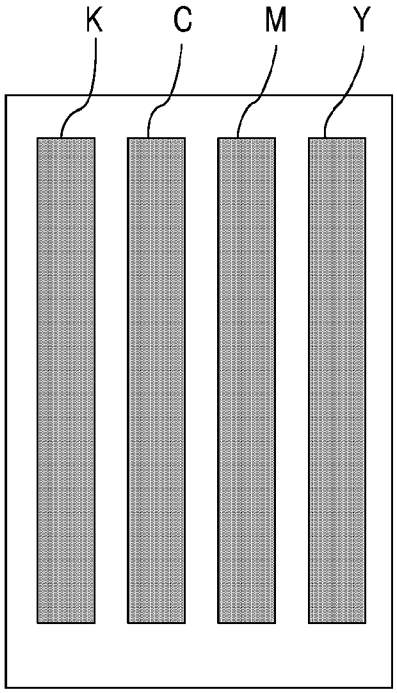

As the driving-direction image-density-deviation correction pattern, for example, as illustrated in FIG. 18B, a pattern can be used in which patches of K, C, M, and Y having long shapes in the driving direction are formed. FIG. 18B illustrates an example in which the patches of K, C, M, and Y are simultaneously formed with the same gradation. Note that the shape, number, layout, and the like of the formed patches are not limited thereto. For example, the number of output sheets may be two or more.

Figure 18C:
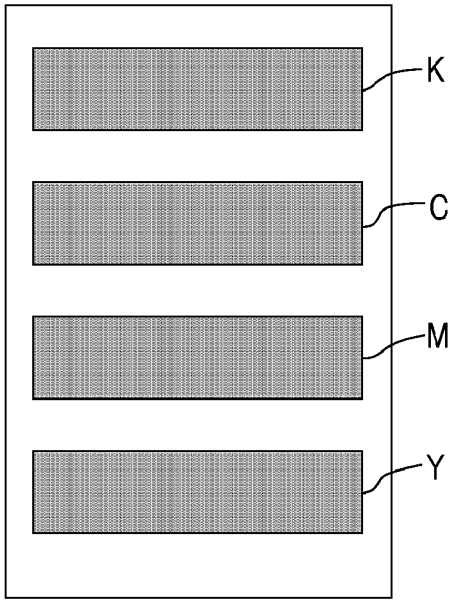

As the pattern for correcting the image density deviation in the orthogonal direction, for example, as illustrated in FIG. 18C, a pattern can be used in which patches of K, C, M, and Y having long shapes in the direction (orthogonal direction) orthogonal to the driving direction are formed. FIG. 18C illustrates an example in which the patches of K, C, M, and Y are formed with the same gradation. Note that the shape, number, layout, and the like of the formed patches are not limited thereto. For example, the number of output sheets may be two or more.

Figure 18D:
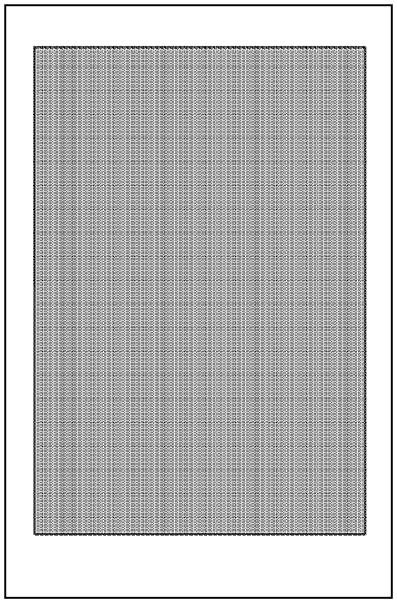

Further, the correction of the image density deviation in the driving direction or the correction of the image density deviation in the orthogonal direction can be simultaneously performed using the entire solid image as illustrated in FIG. 18D. In such a case, the entire solid images of K, C, M, and Y with several gradations may be output over a plurality of sheets to calculate the correction values for the respective colors.

The configurations according to the above-descried embodiments are examples, and embodiments of the present disclosure are not limited to the above-described examples. For example, the following aspects can achieve effects described below.

Aspect 1

According to Aspect 1, an image forming apparatus (for example, the image forming apparatus 1) includes an image forming device (for example, the printer engine 100) that forms an image on a recording material (for example, the sheet P), and an image quality adjustment unit (for example, the image quality adjustment unit 242) that executes image quality adjustment control for adjusting the image quality of the image formed by the image forming device. The image quality adjustment unit is capable of selectively executing a first control mode (for example, "image quality adjustment A") that executes first image quality adjustment control (for example, "image quality adjustment control A") and a second control mode (for example, "image quality adjustment B") that includes both the first image quality adjustment control and second image quality adjustment control (for example, "image quality adjustment control B"). The image quality adjustment unit executes only the second image quality adjustment control without executing the first image quality adjustment control in a case in which an execution skip condition for skipping the first image quality adjustment control is satisfied even when an execution condition for executing the second control mode is satisfied. When the situation has not changed significantly after the image quality adjustment control is executed, such as immediately after the execution of the image quality adjustment control, there is little need to execute the same image quality adjustment control again. Therefore, conventionally, when the elapsed time from the previous execution, the number of printed sheets, or the temperature change is less than the reference, the same image quality adjustment control may not be executed. Such a configuration can restrain a failure such as time loss due to execution of unnecessary image quality adjustment control, wasteful consumption of consumables (toner or the like) due to the execution, and deterioration of components due to the execution. However, in the case in which the first control mode for executing the first image quality adjustment control and the second control mode including both the first image quality adjustment control and the second image quality adjustment control are selectively executed, the execution condition for executing the second control mode may be satisfied at a point in time when the situation has not changed significantly after the first image quality adjustment control is executed. In such a case, even in the case of the second image quality adjustment control that is considered to be based on the completion of the execution of the first image quality adjustment control, the execution of the first image quality adjustment control is not needed. Accordingly, if the first image quality adjustment control that is not needed is executed as it is, the control time would be prolonged by the execution of the first image quality adjustment control. Therefore, in the present aspect, in a case in which the execution skip condition of the first image quality adjustment control is satisfied even when the execution condition for executing the second control mode is satisfied, only the second image quality adjustment control is executed without executing the first image quality adjustment control. Accordingly, appropriately setting the execution skip condition of the first image quality adjustment control can avoid execution of the first image quality adjustment control that is unnecessary to be executed when the second control mode is executed. In executing the second control mode, such a configuration can restrain an increase in control time due to execution of the first image quality adjustment control that is not necessary to be executed.

Aspect 2

According to Aspect 2, in Aspect 1, the execution skip condition includes at least one of a condition that an elapsed time from the previous execution of the first image quality adjustment control is less than a specified time, a condition that the number of images formed (for example, the number of printed sheets) from the previous execution of the first image quality adjustment control is less than a specified number, a condition that an amount of change from temperature at the previous execution of the first image quality adjustment control is less than a specified amount, and a condition that an amount of change from humidity at the previous execution of the first image quality adjustment control is less than a specified amount. Such a configuration can easily and appropriately determine whether execution of the first image quality adjustment control is unnecessary.

Aspect 3

According to Aspect 3, in Aspect 1 or 2, the image forming apparatus includes an input receiving device (for example, the operation panel 60) that receives an input of a user instruction. The execution condition is a condition that the input receiving device receives an input of an instruction to execute the second control mode. In a case in which the second control mode can be executed by a user's instruction, the execution timing and the execution frequency of the second control mode cannot be managed by a program in many cases. Accordingly, a situation in which the second control mode including the first image quality adjustment control that does not need to be executed is executed is likely to occur. According to the present aspect, in a case in which a situation in which the second control mode including the first image quality adjustment control that does not need to be executed is likely to occur, execution of the first image quality adjustment control that does not need to be executed can be avoided in execution of the second control mode.

Aspect 4

According to Aspect 4, in any one of Aspects 1 to 3, the image forming device performs image formation by finally transferring a toner image formed on an image bearer (for example, the intermediate transfer belt 130) onto a recording material (for example, the sheet P). One of the first image quality adjustment control and the second image quality adjustment control includes control (for example, toner adhesion amount correction) for setting a toner adhesion amount of the toner image within a predetermined range. With respect to the image quality adjustment control in which the toner adhesion amount of the toner image is controlled to be within the predetermined range, such a configuration can restrain an increase in the control time due to execution of the image quality adjustment control that is not necessary to be executed.

Aspect 5

According to Aspect 5, in any one of Aspects 1 to 4, the image forming device performs image formation by finally transferring a toner image formed on an image bearer onto a recording material. One of the first image quality adjustment control and the second image quality adjustment control includes control for correcting a deviation in toner adhesion amount of the toner image in a movement direction of a surface of the image bearer (for example, the driving-direction toner-adhesion-amount-deviation correction). With respect to the image quality adjustment control for performing the control of correcting the deviation of the toner adhesion amount of the toner image in the movement direction of the surface of the image bearer, such a configuration can restrain the prolongation of the control time due to the execution of the image quality adjustment control that does not need to be executed.

Aspect 6

According to Aspect 6, in any one of Aspects 1 to 5, the image forming device performs image formation by finally transferring a toner image formed on an image bearer onto a recording material. One of the first image quality adjustment control and the second image quality adjustment control includes control for correcting a deviation in toner adhesion amount of the toner image in a direction orthogonal to a movement direction of a surface of the image bearer (for example, the orthogonal-direction toner-adhesion-amount-deviation correction). With respect to the image quality adjustment control for performing the control of correcting the deviation of the toner adhesion amount of the toner image in the direction orthogonal (perpendicular) to the movement direction of the surface of the image bearer, such a configuration can restrain the prolongation of the control time due to the execution of the image quality adjustment control that does not need to be executed.

Aspect 7

According to Aspect 7, in any one of Aspects 1 to 6, the image forming device performs image formation by finally transferring a toner image formed on an image bearer onto a recording material. One of the first image quality adjustment control and the second image quality adjustment control includes control (for example, the gradation correction) of performing gradation correction of the toner image. With respect to the image quality adjustment control for performing the control of correcting the gradation of the toner image formed on the image bearer, such a configuration can restrain the prolongation of the control time due to the execution of the image quality adjustment control which is not necessary to be executed.

Aspect 8

According to Aspect 8, in any one of Aspects 1 to 7, the image forming device performs image formation by finally transferring a toner image formed on an image bearer onto a recording material. One of the first image quality adjustment control and the second image quality adjustment control includes control (for example, the image density correction) of setting an image density of an image formed on the recording material to a target density. Such a configuration can restrain an increase in the control time due to the execution of the image quality adjustment control that does not need to be executed in the image quality adjustment control in which the image density of the image formed on the recording material is controlled to be the target density.

Aspect 9

According to Aspect 9, in any one of Aspects 1 to 8, the image forming device performs image formation by finally transferring a toner image formed on an image bearer onto a recording material. One of the first image quality adjustment control and the second image quality adjustment control includes control for correcting a density deviation (for example, the conveyance-direction image-density deviation) of an image in a movement direction of a surface of the image bearer. With respect to the image quality adjustment control for performing the control of correcting the density deviation of the image in the movement direction of the surface of the image bearer, such a configuration can restrain an increase in the control time due to the execution of the image quality adjustment control that is not necessary to be executed.

Aspect 10

According to Aspect 10, in any one of Aspects 1 to 9, the image forming device performs image formation by finally transferring a toner image formed on an image bearer onto a recording material. One of the first image quality adjustment control and the second image quality adjustment control includes control for correcting a density deviation (for example, the orthogonal-direction image-density deviation) of an image in a direction orthogonal to a movement direction of a surface of the image bearer. With respect to the image quality adjustment control for performing the control of correcting the density deviation of the image in the direction orthogonal (perpendicular) to the movement direction of the surface of the image bearer, such a configuration can restrain an increase in the control time due to the execution of the image quality adjustment control that is not necessary to be executed.

Aspect 11

According to Aspect 11, in any one of Aspects 1 to 10, the image forming device performs image formation by finally transferring a toner image formed on an image bearer onto a recording material. One of the first image quality adjustment control and the second image quality adjustment control includes image quality adjustment control (for example, gradation correction) for performing gradation correction of an image. With respect to the image quality adjustment control for performing the control of correcting the gradation of the image formed on the recording material, such a configuration can restrain the prolongation of the control time due to the execution of the image quality adjustment control which is not necessary to be executed.

Aspect 12

According to Aspect 12, there is provided an image quality adjustment method for an image forming apparatus that forms an image on a recording material and executes image quality adjustment control for adjusting the image quality of the image to be formed. In the image quality adjustment method, a first control mode for executing first image quality adjustment control and a second control mode including both the first image quality adjustment control and second image quality adjustment control are selectively executable. The image quality adjustment method includes executing only the second image quality adjustment control without executing the first image quality adjustment control, in a case in which an execution skip condition for skipping the first image quality adjustment control is satisfied even when an execution condition for executing the second control mode is satisfied. According to the present aspect, an increase in the control time due to execution of the first image quality adjustment control that is not necessary to be executed can be restrained in execution of the second control mode.

The present disclosure is not limited to specific embodiments described above, and numerous additional modifications and variations are possible in light of the teachings within the technical scope of the present disclosure. It is therefore to be understood that the disclosure of the present specification may be practiced otherwise by those skilled in the art than as specifically described herein. Such modifications and alternatives are within the technical scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image former to form an image on a recording material; and circuitry configured to execute image quality adjustment control for adjusting image quality of the image formed by the image former, wherein the circuitry is configured to selectively execute a first control mode for executing first image quality adjustment control and a second control mode including both the first image quality adjustment control and second image quality adjustment control, and wherein the circuitry is configured to receive instruction to execute the second control mode;

determine that an execution skip condition for skipping the first image quality adjustment control is satisfied in response to the instruction of executing the second control mode; and execute only the second image quality adjustment control without executing the first image quality adjustment control.

2. The image forming apparatus according to claim 1, wherein the execution skip condition includes at least one of a condition that an elapsed time from a previous execution of the first image quality adjustment control is less than a specified time, a condition that a number of images formed from the previous execution of the first image quality adjustment control is less than a specified number, a condition that an amount of change from a temperature at the previous execution of the first image quality adjustment control is less than a specified amount, and a condition that an amount of change from humidity at the previous execution of the first image quality adjustment control is less than a specified amount.

3. The image forming apparatus according to claim 2, wherein the execution skip condition includes at least one of the condition that the amount of change from the temperature at the previous execution of the first image quality adjustment control is less than the specified amount, or the condition that the amount of change from humidity at the previous execution of the first image quality adjustment control is less than the specified amount.

4. The image forming apparatus according to claim 1, further comprising an input receiver to receive an input of a user instruction, wherein the execution condition is a condition that the input receiver receives an input of an instruction to execute the second control mode.

5. The image forming apparatus according to claim 1, wherein the image former transfers a toner image formed on an image bearer onto a recording material to perform image formation, and wherein one of the first image quality adjustment control and the second image quality adjustment control includes control of setting a toner adhesion amount of the toner image within a predetermined range.

6. The image forming apparatus according to claim 1, wherein the image former transfers a toner image formed on an image bearer onto a recording material to perform image formation, and wherein one of the first image quality adjustment control and the second image quality adjustment control includes control of correcting a deviation in toner adhesion amount of the toner image in a movement direction of a surface of the image bearer.

7. The image forming apparatus according to claim 1, wherein the image former transfers a toner image formed on an image bearer onto a recording material to perform image formation, and wherein one of the first image quality adjustment control and the second image quality adjustment control includes control of correcting a deviation in toner adhesion amount of the toner image in a direction orthogonal to a movement direction of a surface of the image bearer.

8. The image forming apparatus according to claim 1, wherein the image former transfers a toner image formed on an image bearer onto a recording material to perform image formation, and wherein one of the first image quality adjustment control and the second image quality adjustment control includes control of performing gradation correction of the toner image.

9. The image forming apparatus according to claim 1, wherein the image former transfers a toner image formed on an image bearer onto a recording material to perform image formation, and wherein one of the first image quality adjustment control and the second image quality adjustment control includes control of setting an image density of an image formed on the recording material to a target density.

10. The image forming apparatus according to claim 1, wherein the image former transfers a toner image formed on an image bearer onto a recording material to perform image formation, and wherein one of the first image quality adjustment control and the second image quality adjustment control includes control of correcting a density deviation of an image in a movement direction of a surface of the image bearer.

11. The image forming apparatus according to claim 1, wherein the image former transfers a toner image formed on an image bearer onto a recording material to perform image formation, and wherein one of the first image quality adjustment control and the second image quality adjustment control includes control of correcting a density deviation of an image in a direction orthogonal to a movement direction of a surface of the image bearer.

12. The image forming apparatus according to claim 1, wherein the image former transfers a toner image formed on an image bearer onto a recording material to perform image formation, and wherein one of the first image quality adjustment control and the second image quality adjustment control includes image quality adjustment control of performing gradation correction of an image.

13. The image forming apparatus according to claim 1, wherein the circuitry includes a central processing unit (CPU), a read only memory (ROM), and a hard disk drive (HDD), wherein the CPU is configured to execute a program stored in the ROM or the HDD to perform image quality adjustment control of an image to be formed.

14. The image forming apparatus according to claim 13, wherein the CPU is configured to control operations of the image forming apparatus.

15. The image forming apparatus according to claim 14, further comprising a random access memory (RAM), wherein the CPU is configured to execute programs stored in the ROM or the HDD and use the RAM as a work area to control the operations of the image forming apparatus.

16. An image quality adjustment method for an image forming apparatus that forms an image on a recording material and executes image quality adjustment control for adjusting image quality of the image formed, the image quality adjustment method comprising:

selectively executing a first control mode for executing first image quality adjustment control and a second control mode including both the first image quality adjustment control and second image quality adjustment control;

receiving instruction to execute the second control mode;

determining that an execution skip condition for skipping the first image quality adjustment control is satisfied in response to the instruction of executing the second control mode; and executing only the second image quality adjustment control without executing the first image quality adjustment control.

* * * * *